US012502598B1

(12) United States Patent
Curley

(10) Patent No.: US 12,502,598 B1
(45) Date of Patent: Dec. 23, 2025

(54) AUTOMATIC SHOE LOADING MECHANISM

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

(21) Appl. No.: 19/090,530

(22) Filed: Mar. 26, 2025

Related U.S. Application Data

(63) Continuation of application No. 18/967,498, filed on Dec. 3, 2024, now Pat. No. 12,311,255.

(51) Int. Cl.
*A63F 1/12* (2006.01)
*A63F 1/14* (2006.01)

(52) U.S. Cl.
CPC ..... *A63F 1/12* (2013.01); *A63F 1/14* (2013.01); *A63F 2250/58* (2013.01)

(58) Field of Classification Search
CPC ..... A63F 1/12; A63F 1/14
See application file for complete search history.

(56) References Cited

U.S. PATENT DOCUMENTS

| | | | | |
|---|---|---|---|---|
| 7,584,963 | B2 * | 9/2009 | Krenn | A63F 1/12 273/149 R |
| 10,814,212 | B2 * | 10/2020 | Blaha | A63F 1/12 |
| 2020/0171375 | A1 * | 6/2020 | Litman | A63F 1/12 |

* cited by examiner

*Primary Examiner* — Michael D Dennis
(74) *Attorney, Agent, or Firm* — Chris Tanner; BlueCollarIP.com

(57) ABSTRACT

A compact card handling device for use in casinos possesses a card input portal and two playing card discharge portals which are all accessible by a device operator. An optical recognition sensor cooperates with a microcontroller to interrogate the integrity of each card during an ongoing shuffling operation to discover unexpected cards, including unrecognized cards and flipped cards. Expected cards are randomized and accumulated into a stack whereupon those cards are thereafter delivered to a first discharge portal comprising a conventional multi-card shoe. Unexpected cards are immediately discharged to a second portal where they may be visually examined by the device operator while a shuffling operation continues. The input portal and the shoe are clustered conveniently upon the surface of a casino table while the bulk of the machine resides below the table surface.

15 Claims, 21 Drawing Sheets

(1997)

(1997)

(2003)

(2003)

FIG. 10
PRIOR ART
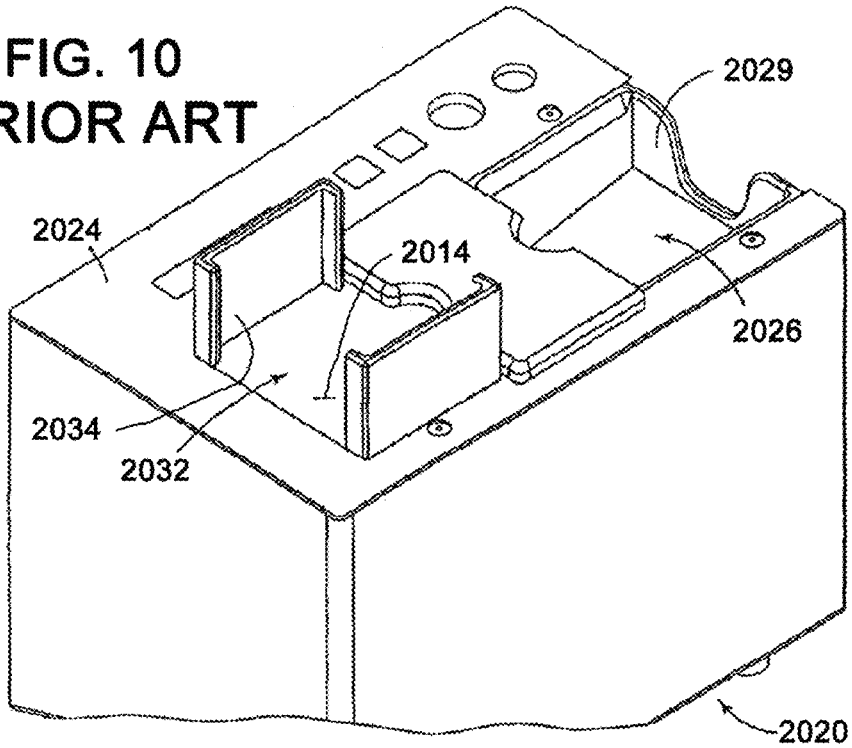
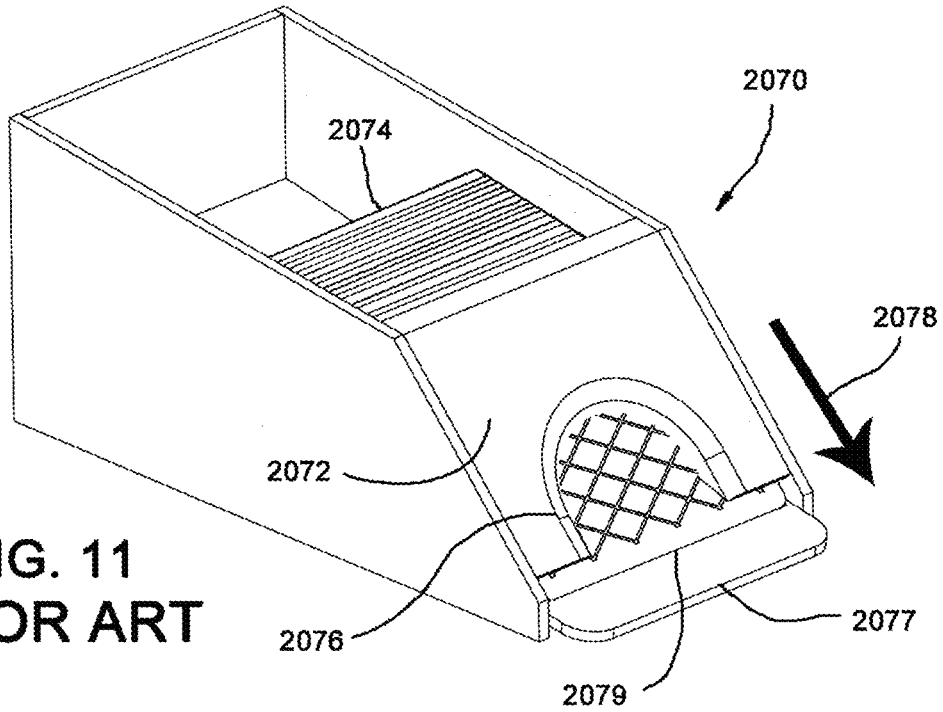
FIG. 11
PRIOR ART

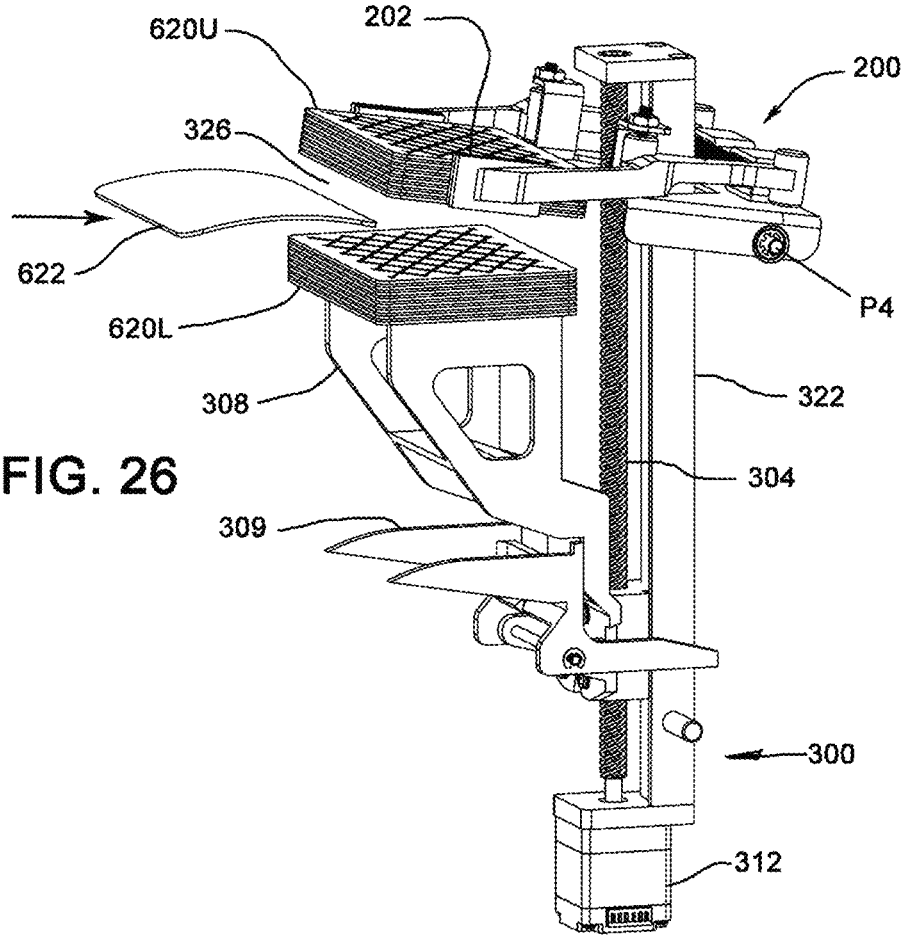
FIG. 26
FIG. 27
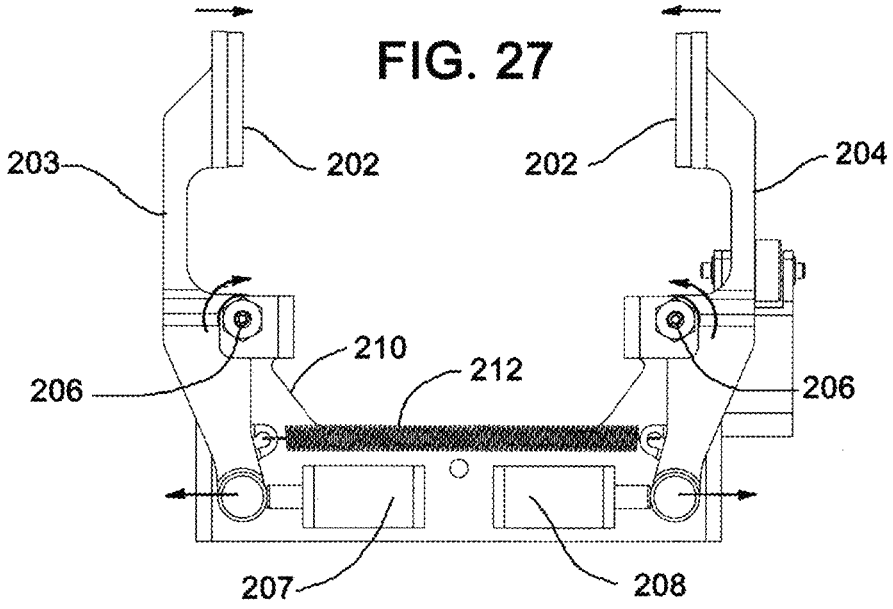

AUTOMATIC SHOE LOADING MECHANISM

FIELD OF THE INVENTION

The present invention is related to the field of automatic electromechanical shuffling machines which are used by casinos to speed up the rate of play of dealer-hosted card games. More particularly, the invention relates to shuffling machines which automatically deliver playing cards to a conventional table-mounted shoe. The invention also relates to shuffling devices which utilize interrogation sensors to recognize marks and or indicia on playing cards for security purposes during shuffling operations for the purpose of maintaining card deck integrity.

BACKGROUND

Card games such as Blackjack are major attractions in casinos because they are relatively easy to play and allow wagering to various degrees of risk. A single deck or multiple decks of 52 playing cards are often used in these games, which must be periodically shuffled to effect randomness of the rank and suit of the individual cards within each deck. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

The prior art teaches that automatic shuffling machines have traditionally utilized image sensors to ensure the integrity of a card deck by sensing and tracking the identity of every card within a deck during the shuffling process. Contact Image Sensors (CIS) were invented in the 1970's for use in facsimile machines and have since been adopted for image sensing in various shuffling machines. Similarly, CMOS image sensors invented for use in digital cameras and scanners have also been adopted in the shuffler art. Numerous prior art references teach optical recognition devices that read identification marks and/or indica on each card to verify that the deck is complete and does not contain extraneous cards. Automatic shuffling machines verify that each and every card of each suit is included as required by the game being played, and that there exists no missing or extraneous cards resulting from machine malfunction or cheating.

For example, prior art U.S. Pat. No. 5,989,122 (Roblejo '122) appears to have pioneered the use of optical recognition sensors that are utilized to verify card deck composition. The Roblejo '122 embodiment is reproduced in FIG. 1 and discloses an automatic shuffler that utilizes an optical card reader 2044 which reads rank and suit of individual cards before they are moved from an unshuffled input stack 2042 to its randomizing mechanism. The role of the optical recognition device is to verify the composition and completeness of a set of playing cards prior to randomizing. Referring to FIG. 1, Roblejo '122 explains that an apparatus 2040 has a control means 2041, an input means for receiving playing cards onto an input stack holder 2042, and buffer means having a plurality of slots for temporarily holding cards, illustrated as a wheel 2043 (carousel) having a plurality of slots 2048. The apparatus additionally possesses identification means for reading indicia, illustrated as bar code reader 2044 to determine identity of playing cards which can be specially marked with bar codes or other coded information. Alternatively, the cards can be unmarked.

"It is an object of this invention to provide an apparatus and method for receiving cards, either from new decks or after the cards have been played, to shuffle the cards in a randomized order, and simultaneously to verify the accuracy of the set or sets of cards in the deck or decks. (Roblejo '122 col. 2; lines 22-27)

"The means for reading indicia is preferably either a bar code reader, Video optical System, optical Scanner, reader of hologram information, or reader of magnetic indicia (Roblejo '122, col. 3; lines 65-67)".

Roblejo '122 also disclosed the use of the apparatus as a card deck verification apparatus, independent of its functions as a card shuffler.

"In another aspect, the invention comprises a process comprising providing such an apparatus, feeding to the input means one or more cards either after they have been played in a game or from an unrandomized or unverified set, and manually retrieving a verified true set of cards from the stacking means." (Roblejo '122, col. 2; lines 53-58)

A myriad of subsequent prior art disclosures have described card shufflers which employ inspection stations. An audible or visual signal is usually made to alert the operator when a card fails the inspection criteria. However, much of the prior art is silent or indefinite regarding the destiny of a card that fails the inspection criteria and thereafter is entrapped within the apparatus. Moreover, such a faulty card by definition creates a faulty deck which is also entrapped within the apparatus. The destiny of the faulty card and/or the faulty deck is seldom addressed in the prior art. This is also the case with Roblejo '122. Since Roblejo '122 does not teach an alternate card path, one of ordinary skill can only assume that the faulty card must be transported into one of the compartments of its carousel. Thereafter, the shuffling operation must be aborted and the carousel must be unloaded compartment by compartment to remove the faulty deck. Alternately, the shuffler must just cease the randomizing operation upon identifying a faulty card.

An excerpted illustration from prior art U.S. Pat. No. 6,629,894 (Purton '894) is shown in FIG. 2 and teaches alternative configurations of a digital camera (commonly known as a CMOS camera) arranged to inspect rank and suit of each card as a machine passes each card from one stack to another. Cards from a card stack 2000 on platform 2001 are fed from the bottom of the stack via a drive roll 2002 to pinch rolls 2007, which facilitate movement to card stack 2005. In one embodiment the cards of card stack 2000 are face down and a first camera 2003 reads the face of the cards within the card stack 2000 via a window 2004 of the platform 2001. Alternatively, digital camera 2006 can be mounted below the pinch rolls 2007 such that a face of the card can be read between the card stacks 2000 and 2005. In another embodiment, a camera 2006 is above the pinch rolls 2007 to read any cards that are face up between card stacks 2000 and 2005. Purton does not teach an alternate card path for those cards that fail its inspection criteria.

Purton '894 states:

"The camera reads the face of the cards and using on board image processing, provides a data output which includes the suit and value portion of the face of the card. (Purton '894 col. 5; lines 67, col. 6; lines 1-3)

"[A] a card stack may be supported by a platform through which a drive roller extends. This allows cards to be fed from the bottom of the stack. In this embodiment, the cards are placed face down. So that each card may be read by an upward looking digital camera, the platform is provided with a window or opening. In the alternative, the cards may be read between stacks, by a digital camera mounted above (with the cards face up) or below the pinch rollers (with the cards face down) which facilitate card transport between the two stacks." (Purton '894 col. 4; lines 60-67, col. 5; lines 1-3)

In the case of flipped cards, prior art U.S. Pat. No. 6,403,908 (Stardust '908) teaches that it resolves flipped cards by physically flipping them within its apparatus. Flipped cards are those cards whose face (indicia surface) reside in a direction contacting the face direction of its neighbors within a stack. The Stardust '908 disclosure explains the use of optical recognition for inspecting decks of playing cards by utilizing a scanner or digital camera to scan one card indicia at a time. Stardust '908 explains that images taken by cameras are supplied to a comparison circuit in the control processor which compares these images with stored images of a corresponding deck of cards to determine which card and what color card is detected by the camera or cameras. A digital camera or scanner can be used according to the disclosure.

Stardust '908 however fails to teach any physical structure or practicable embodiments for its invention, but instead describes the apparatus abstractly in terms of block diagrams and symbol diagrams. The Stardust '908 specification refers to Stardust '908 FIG. 5 and Stardust '908 FIG. 6 as the embodiments of the invention, but those figures are merely block diagrams. For example, Stardust '908 explains that flipped cards can be identified at its inspection station and thereafter flipped by a "digital imaging station/flipper 116". However, "digital imaging station/flipper 116" is shown only as a rectangle in a block diagram within the Stardust '908 disclosure. An illustration of an embodiment of a card flipping mechanism which could be practiced by one of ordinary skill appears nowhere in the Stardust '908 disclosure. The card flipping mechanism is instead described indefinitely as a "means for flipping the playing card":

Mechanical means for flipping the playing card over to expose its opposite side could comprise any number of elements including, but not limited to, rotatable gripping prongs, or any one of a variety of rotating shelf members which pivot about a predetermined pivot point. (Stardust '908 col. 9; lines 46-50)

Prior art U.S. Pat. No. 6,676,127 (Johnson '127) discloses a collating apparatus for providing sorted and/or shuffled decks of playing cards which utilizes a CCD digital camera. Johnson '127 discloses that the camera is utilized to read the rank and suit of a deck of cards as each card passes by a scanning station. The camera described in Johnson '127 is model EB100/E-6 made by EverFocus® Electronics, which is a 492×510 pixel CMOS camera. Johnson '127 states:

"Thus, the device of the present invention is capable of accounting for all cards, and for producing an error signal when there are too few or too many cards. The device may also be equipped with a display that provides a visual indication of the particular cards missing or extra cards present, or the total card count." (Johnson '127 col. 4; lines 64-67, col. 5; lines 1-2)

U.S. Pat. No. 5,722,893 (Hill '893) discloses an optical sensor used to scan the rank and suit of a playing card as a dealer removes each playing card from a card dispensing shoe. Verification is achieved by comparing bit maps from the sensor to bit maps that are stored in memory. Hill '893 states:

"The present invention is directed to a shoe of the type described wherein the shoe has a card scanner which scans indicia on a playing card as the card moves along and out of a chute by manual direction by the dealer in the normal fashion. The scanner can be one of several different types of devices which will sense each card as it is moved downwardly and out of the front of the shoe." (Hill '893 col. 1; lines 41-46).

Even with optical card recognition and verification means, mechanical shuffling machines are not infallible, and suffer from various errors caused by several sources including cheating, lost cards, flipped cards, contamination, bent cards and covertly inserted cards. The verification is useful however, because it can prevent further play with a card deck that suffers from various illicit conditions. For example, prior art U.S. Pat. No. 11,376,489 (Scheper '489) discloses the problem of the shuffler encountering lost cards or flipped cards. Scheper '489 explains:

"If the shuffler stops shuffling for any reason, such as detecting extra or fewer cards in the set, or due to a shuffler malfunction, the game may be delayed, and revenue can be lost. Although it is desirable to stop a game that is using an invalid set of cards for security reasons, there are other reasons why a game might be delayed, such as when a shuffler malfunctions or the shuffler aborts the shuffle because of unreadable cards." (Scheper '489 col. 2; lines 57-67, col. 3; lines 1-2)

"Flipped cards and unrecognized cards typically cause the machine to abort the entire shuffle. Any time a shuffle is aborted, the game can be delayed, causing revenue loss to the casino." (Scheper '489 col. 3; lines 5-14)

The problem of flipped cards has been addressed in several prior art disclosures. U.S. Pat. No. 11,173,383 (Krenn '383) discloses the problems imposed by flipped cards in automatic shufflers, wherein the indicia face of the playing card faces upward rather than downward. Krenn '383 states:

"The card imaging device may be configured to identify whether a card face of the at least some of the playing cards are positioned in an expected orientation or whether the card face is in an unexpected orientation comprising one or more flipped cards." (Krenn '383 col. 1; lines 67, col. 2; lines 1-4)

"When placing the cards in the discard pile and/or infeed area of a shuffling device, the dealer should reorient the cards face-down such that the cards are all oriented in the same way. However, cards are frequently reinserted into the card shuffling devices in the wrong face orientation. In additional embodiments, a new deck of cards may include cards in an erroneous orientation. Regardless of the case, cards inserted with the wrong face orientation may cause delays or errors in the automatic shufflers. For example, a card inserted in the wrong face orientation may cause the shuffling devices to stop the shuffle and alert the dealer through an error message or to abort the shuffle entirely resulting in a delay for the associated gaming table." (Krenn '383 col. 5; lines 6-18)

Shufflers that utilize narrow combs or carousels are particularly problematic when encountering flipped cards because the deck that remains embedded within the shuffler after identifying an unreadable card may need to be purged. U.S. Pat. No. 10,668,361 (Stasson '361) describes an automatic card shuffler which ceases operation in the event of failed verification, thus delaying casino play, but does not explain the disposition or destiny of the remaining deck whose cards remain trapped within the elevator comb, which is shown in FIG. 3. Stasson '361 states:

"In the event that the verification process determines that the set of cards is incomplete or otherwise inaccurate, the card shuffler 100 may be configured not to dispense the shuffled cards and to display an error message or other signal to a user using the data output device 296 of the control system 280." (Stasson '361 col. 24; lines 57-62)

An exemplary shuffler disclosure is U.S. Pat. No. 8,381,918 (Johnson '918) which explains a carousel shuffler with an optical recognition device and a control panel that notifies the dealer when a faulty card is identified and may also reject individual faulty cards. Johnson '918 states:

"For example, a reject mechanism 8 may be associated with the sensor 15 to cause duplicate or oversupplied cards to be rejected before delivery by delivery carriages 18 to the magazine 20. The reject mechanism 8 may comprise an electromechanical device or air blast means coupled to the microprocessor 16. (Johnson '918 col. 5; lines 29-34)

"At the end of sorting, if any deck of cards is incomplete or over-supplied, a warning signal will be actuated in association with that deck to indicate the incomplete or oversupplied stack of cards. By actuating a liquid crystal display (LCD) or light-emitting diode (LED) display 28, this will indicate which card is missing or over-supplied and will also then indicate any other deck which is incomplete or over-supplied." (Johnson '918 col. 4; lines 46-52)

Johnson '918 distinguishes itself from others by the faulty card reject mechanism. However, Johnson '918 fails to provide an embodiment for its "electromechanical device or air blast means". The Johnson disclosure furthermore makes no attempt to explain the destiny of the resulting faulty card that is removed by the "electromechanical device or air blast means".

U.S. Pat. No. 11,898,837 (Krenn '837) discloses a highly complex compartment-type shuffler that utilizes a carousel as shown in FIG. 5. The apparatus can randomize a single 52-card deck of standard playing cards and includes a "defect detection system". The "defect detection system" includes an optical card recognition sensor that can identify rank and suit of each individual card, allowing the controller to thereafter utilize an output mechanism to divert faulty cards to a temporary storage compartment. The defective cards include cards whose "rank and suit cannot be determined, is marked, or otherwise adulterated". In one embodiment, the temporary storage compartment is referred to as "a vault".

Referring to FIG. 5, Krenn '837 discloses a device having an unshuffled card input area 830 for receiving a stack of unshuffled cards, a carousel 850, and card output mechanisms 866 and 868. Individual cards 870 are moved from the input area 830 past a "defect detection mechanism" 840 by feed rolls 860. Cards which are considered faulty are diverted to the vault 810 and non-faulty cards are directed into the carousel 850 where they are randomized by disgorging cards from the carousel compartments in a random order.

The "vault" 810 is a "removable rectangular prism and sized to hold bulk quantities of bent, folded, creased, kinked, and/or frayed cards in the compartment for subsequent removal, inspection, recycling, repurposing, or any combination of these". Although not specifically mentioned, one of ordinary skill will understand that the unreadable cards must also be diverted to the removeable vault. Nowhere in the disclosure do the inventors explain what action is taken by the apparatus after a faulty card has been detected and diverted to the isolation vault, leaving a partially shuffled deck trapped within the carousel. The process of diverting just one faulty card to an inaccessible compartment in itself creates an unusable deck which requires unloading from the carousel.

It can be observed that compartment-type shufflers (carousel or moving comb) require laborious, time-consuming activity to be unloaded when a faulty card is identified. In contrast, batch shufflers which handle discrete decks can be unloaded more quickly. U.S. Pat. No. 10,022,617 (Stasson '617) discloses a batch shuffler apparatus described as a "shuffling and verifying apparatus" which discloses an optical recognition device called an IDC ("image data-taking component") which is intended to read rank and suit of cards. Stasson '617 states:

"The card verification device of the present invention may be used to read and verify cards at various stages of card use, as the verification of cards is often desirable before, and after play of casino card games." (Stasson '617 col. 44; lines 8-11)

Nowhere in Stasson '617 do the inventors explain what action is taken by the apparatus when a faulty card has been detected. Since the apparatus has but one card deck output tray, it is clear that the faulty deck must be raised to that output tray and thereafter manually removed by the dealer when a faulty card is detected. Alternatively, a dealer in collusion with a cheating player may simply continue the card game with the faulty card.

U.S. Pat. No. 10,532,272 (Bourbour) also describes a batch shuffling apparatus. The specification explains:

"When combined with the ability to read card rank and suit, the device is capable of verifying that all cards are present and verifying the final order of the cards." (Bourbour '272 col. 17; lines 7-10)

"In one example of the invention, if cards are missing or extra cards are present, the display will indicate a misdeal and will automatically unload." (Bourbour '272 col. 17; lines 31-33)

Bourbour '272 did not disclose a means for the apparatus to automatically unload a faulty deck of cards. Instead, the apparatus is only capable of elevating the faulty deck to the card deck output tray where it must be manually removed by the dealer. Bourbour '272 thus suffers from the same limitation as the Stasson '617 described above. Since the elevator of the randomizer mechanism is used to hold the faulty deck in its output tray, the apparatus cannot continue the processing (shuffling & verification) of the deck until that faulty card is found and manually removed. The casino game may therefore be stopped until a new deck is inserted into the apparatus and thereafter shuffled, causing interruption of the casino game. Furthermore, that apparatus is subject to dealer-player collusion because the dealer is responsible for manually removing a faulty card.

Prior art U.S. Pat. No. 11,376,489 (Scheper '489) teaches a complex shuffling device which uses multiple elevators and a carousel as shown in FIG. 4. Scheper '489 teaches that unreadable cards are moved to a dedicated compartment within its carousel.

The playing card shuffling apparatus may be configured to receive the one or more unreadable playing cards in at least one dedicated compartment selected from the multiple compartments. (Scheper '489 col. 6; lines 36-39)

Referring to FIG. 4, Scheper '489 discloses a shuffling device that is embedded into a casino table and having a top surface 884 "that may be substantially co-planar with the table surface". Card input area 890 is attached to an elevator 890 which moves cards from an upper loading position to a lower feeding position where cards are individually transported past a card imaging system within the transport mechanism 888. Cards are thereafter directed into a compartment of the carousel 886, where one particular compartment is dedicated for receiving unreadable cards. The unreadable cards in the dedicated carousel compartment are then unloaded after the properly shuffled and verified cards are unloaded, and can then be examined by the machine operator.

At the end of the card distribution process, if any unreadable cards are present in a designated compartment of the shuffling mechanism, those cards may be unloaded last at operation 2014 from the at least one designated compartment and combined with the set of cards in the card output. (Scheper '489 col. 31; lines 65-67, col. 32; lines 1-2)

The dealer may then remove any cards that do not belong in the deck, reorient the flipped cards and activate the shuffler to refeed the cards. (Scheper '489 col. 32; lines 12-15)

Although Scheper '489 teaches the separation and isolation of flipped cards, it does not provide a means for an operator to access those problematic cards such that the flipped cards can be remediated during an ongoing shuffling operation.

Recent U.S. Pat. No. 11,577,151 (Helsen '951) discloses a continuous shuffler that can move problematic cards in a reverse direction along its card path back to its card infeed tray after interrogation at an inspection station. The disclosure explains that the device will signal an error condition to the device operator and cease the ongoing randomizing operation. Card movement from the infeed tray is disabled and the shuffling operation cannot commence until the operator takes action to inspect the problematic card and restart the operation.

Improved reliability is achieved in the card handling device being described herein by implementing a unique randomizing mechanism which avoids the jamming problems associated with narrow slotted compartments that result from warped cards or bent cards. FIGS. 3, 4, 5, 12 and 16 all show exemplary shufflers having such narrow slotted compartments. The problem of narrow slots is discussed within the disclosure of U.S. Pat. No. 11,338,194 (Helgesen '194) which can be understood by observing FIG. 3. Helgesen '194 explains:

"For example, one card in a deck may be bent or warped—causing the card to regularly fail to insert into its assigned upper or lower position during each shuffle." (Helgesen '194 col. 28; lines 63-65)

A more reliable randomizing mechanism was taught by prior art U.S. Pat. No. 5,683,085 (Johnson '085), which discloses a randomizing apparatus that is devoid of narrow-slotted combs, racks and compartments. As shown herein as FIG. 6, Johnson discloses a shuffling apparatus which possesses a "main shuffling chamber" 2200. A mechanical gripping member 2208 is attached to a mechanical gripping arm 2206 which can move vertically to random positions in chamber 2200 as commanded by a microprocessor. The arm 2206 grips and the lifts substack 2202 at random positions which enables the insertion of an individual card 2210 from a secondary deck (unshuffled deck) 2212. The separating mechanism creates an opening between two sub-stacks 2202 and 2204, which allows the insertion of card 2210 from the secondary stack 2212 into the receiving stack at the opening. Johnson '085 simulates the well-known action that a dealer utilizes to manually insert a "cut card" into a deck as illustrated herein as FIG. 7.

The Johnson Method as shown in FIG. 6 illustrating Johnson '085 can be further understood from FIGS. 8A and 8B where a generic gripper arm is labeled 640. The gripper arm is mounted to an elevator which positions the arm at random vertical planes adjacent to the card stack 620 as shown in FIG. 8A. Referring to FIG. 8B, the gripper arm thereafter grasps a portion of the card stack 620U and lifts it upward, creating an opening to insert a playing card 626. The gripper arm thereafter lowers the upper stack onto the lower stack. The cycle is repeated until the desired number of cards are inserted randomly into the accumulated randomized stack 620.

Subsequent prior art U.S. Pat. No. 6,651,982 (Grauzer '982) also adopted a gripper mechanism. Whereas Johnson '085 has elevated the gripper to select a subset of cards, Grauzer '982 discloses that the gripper is held stationary, while the platform below is vertically lowered away from the gripper. Referring to FIGS. 9A and 9B, Grauzer '982 mounted the gripper arm 640 in a vertically stationary position and instead moved the card stack 620 with the elevator. After splitting the stack 620, the sub-stack 620L was lowered to create the opening for inserting card 626. After insertion, the lower substack 620L was thereafter raised to abut against the upper sub-stack 620U and the gripper was released. As compared to Johnson '085, Grauzer '982 lowered the lower sub-stack 620L rather than raising the upper sub-stack 620U as was taught by Johnson '085. Both prior art disclosures taught the advantages of avoiding narrow-slotted elevators or carousels.

One way to sustain rate of table play in a casino is for the dealer to utilize a "two-deck rotation" where one set of cards may undergo a shuffling cycle while another group is being utilized in a table game. Shuffling machines which facilitate the "two-deck rotation" usually possess an unshuffled card input portal and a shuffled card output portal and are physically located near the casino table. Such a prior art example is shown in FIG. 10 as taught by U.S. Pat. No. 6,651,982 (Grauzer '982), where the recess 2026 is a card receiving area for receiving unshuffled cards, and the recess 2032 is a shuffled card return area. Stacks of unshuffled cards are released into the mechanism below the recess 2026 where they are randomly rearranged and thereafter raised to the recess 2032 by elevator surface 2014. Shuffling of another unshuffled deck (or decks) is able to commence only after the newly-shuffled deck (or decks) are removed from the elevator surface 2014 by the dealer.

While the shuffling machine is shuffling the previously "played" deck (or decks), the dealer uses a newly-shuffled deck (or decks) to execute the game with the players. When that deck (or decks) are reasonably depleted, the dealer can then return that deck (or decks) to the shuffling machine and fetch a newly-shuffled deck (or decks) from that machine, such that there is relatively little interruption in play. While the game is being played with one deck (or decks), a newly-shuffled deck (or decks) are being made ready within the automatic shuffler.

Following a shuffling cycle, a dealer removes the shuffled cards from the discharge portal 2032 and moves them to a card delivery shoe that is located on the casino table. A conventional delivery shoe 2070 is shown in FIG. 11 wherein a plurality of cards 2074 are stored and wherein a dealer may withdraw each card 2079 rapidly with a downward motion along the surface of an angular draw plate 2072 in the direction of arrow 2078 by swiping his/her finger through finger opening 2076. A wedge-shaped member (not shown) resides behind the card stack 2074 and pushes the stack toward the inner surface of the draw plate 2072. The rendering in FIG. 12 is made directly from a CAD (computer-aided design) model of a commercially available shoe having a capacity of four decks.

The dealer also has a card discharge rack on the casino table where he/she deposits cards that have already been utilized in a card game. The dealer moves those cards from the discharge rack to the unshuffled card input portal of the automatic shuffler when it is appropriate to initiate a new shuffling cycle.

A natural convenience goal for an automatic shuffler is to integrate the card delivery shoe within the shuffling device such that the shoe functions as the output portal. Prior art U.S. Pat. No. 9,370,710 B2 teaches such a configuration as shown in FIG. 12. This patent was issued in June of 2016 to Attila Grauzer et al (Grauzer '710) and disclosed a shuffler having a linear stack of compartments. This device discloses a shoe positioned on its mounting surface. Cards are moved from the input portal 2053 into compartments 2054 where they are accumulated into substacks. Substacks within each compartment 2054 are thereafter individually pushed into the shoe 2057 by a motorized pusher 2052 which is driven by motor 2056 and sprocket 2055. FIG. 13 illustrates a view of device 2050 with its casing covers as they would appear on a casino table. Since the card delivery shoe must reside upon the table surface, this configuration results in a rather large device which rests obtrusively upon a casino table surface.

A goal of several prior art automatic shufflers is to position the shuffling device below the casino table surface so as to make the device unobtrusive. FIG. 14 is excerpted from prior art US patent Application US2020/0171375 A1 which was filed in December 2018 by inventor Mark Alan Litman (Litman '375). The Litman '375 disclosure teaches that a "hand-forming" shuffling device may be embedded within a housing or table such that the uppermost casing surface 940 resides flush with the table surface. A "hand-forming" shuffler discharges pre-formed hands to a discharge portal where a device operator may issue each hand to a player. An elevator 930 is described for receiving shuffled cards in the Litman '375 disclosure. The elevator appears to be functionally equivalent to a container for temporarily storing stacks of shuffled cards. In one embodiment, the elevator 930 is removed from the device manually using a handle 918. In another embodiment, undisclosed mechanical means are used to lift the elevator housing. The disclosure explains;

FIG. [14] shows a manually lifted elevator [930]. (Litman '375 @ [0046])

> There may be gear drives, friction wheels, chain gears and the like (not shown) adjacent the sides of the elevator [930] to raise the elevator if that is preferred to a manual lift. (Litman '375 @ [0048])

By embedding the "hand-forming" shuffling device within a table, Litman '375 teaches that the cards located at the base of the elevator 924 are not accessible to the device operator, with the consequence that hands formed by the shuffler cannot be sequentially delivered to the players as they are delivered to a delivery tray. The disclosure fails to teach any mechanism for sequentially moving individual substacks of cards to a delivery tray or delivery shoe that is accessible at the casino table surface.

Less obtrusive integrated shoe shufflers configure the card delivery shoe upon the casino table surface as an integral part of the shuffling device with the randomizing mechanisms residing below the table surface. FIG. 15 is excerpted from prior art U.S. Pat. No. 10,814,212 B2 to Ernest Blaha (Blaha '212) which was granted in October of 2020. This configuration allows the card delivery shoe 2102 to reside upon the surface of table 2128 at an elevation above a carousel 2104 whose housing is mounted upon the edge of table 2128, allowing the randomizing mechanism to reside unobtrusively at an elevation below the table surface. Unshuffled cards are placed into a rotatable magazine 2114 which rotates about pivot 2110 in the direction of arrow 2112 to a closed position shown as 2120. When in the closed position, transport rolls 2108 move cards from the magazine into the carousel 2104. Cards are removed from the carousel at a different station by a pusher 2105 (not described) and transported into the shoe 2102 by rolls 2116 and rolls 2118. The physical location of an operator control panel is not disclosed, although the disclosure explains that the control system "may include one or more displays" (Blaha '212 14:17-18).

The configuration illustrated in FIG. 15 is however not convenient for a dealer operating multi-round game such as Blackjack because the cards must be loaded into the shuffler at an elevation below the table. This requires the task of opening and closing a magazine door 2114 at the end of each round of play. The disclosure also describes a multi-compartment carousel 2104 having forty-three compartments (Blaha '212 7:57). As with other carousel configurations, a device with forty-three compartments cannot be made nearly as compact as the device being claimed herein. Moreover, carousel devices require motorized pusher mechanisms (sometimes called "packers") to push the cards into the carousel slots, and motorized extractor mechanisms to remove cards from the carousel slots. These motorized mechanisms add extra manufacturing cost.

FIG. 16 shows another shuffling device having a large carousel. This figure is reproduced from prior art U.S. Pat. No. 10,632,363 B2 which was granted to inventor Peter Krenn in April 2020 (Krenn '363). This disclosure describes a large carousel 2144 with thirty-nine compartments and a rather complex overall structure which may be mounted upon the edge of a casino table 2142. The discharge portal 2138 is described in the disclosure as a "substantially flat card output area" and label 2134 is described as the "card intake area". This configuration achieves the advantage of locating the discharge portal and input portal adjacent to each other at the surface of a casino table, but however locates the control panel remotely on an angular housing surface.

Krenn '363 lacks a conventional card delivery shoe having a supply of cards for quick removal. Krenn '363 instead describes a discharge portal having a "substantially flat card shoe" (Krenn 363 4:47-48). Since the shoe can accommodate only one card at a time, individual cards must be transported one at a time to the "substantially flat draw surface" (Krenn '363 Abstract) after having been separated from a substack located at an elevation below the shoe. A second card cannot be elevated to the "flat draw surface" until a first card has been removed from that surface.

SUMMARY OF THE INVENTION

One goal of the SECURE SHUFFLER WITH SHOE described herein is to introduce a more competitive integrated shoe shuffler than those which are referenced in the above prior art, by achieving discernable manufacturing cost reductions. In comparison to compartment shufflers, the card handling device within this disclosure achieves these manufacturing cost reduction goals by eliminating the need for motorized pusher and packer mechanisms and eliminating the complexity, manufacturing cost and bulk of a carousel, thus achieving an integrated shoe shuffler that requires less parts, is more compact and is more economical to manufacture than the referenced prior art. For example, many prior art shuffler devices require six or more motors. The card handling device described herein requires only four motors.

A second goal of the SECURE SHUFFLER WITH SHOE is to achieve a compact integrated shuffling device having a multi-card shoe which can reside unobtrusively on or near a casino table in a convenient location adjacent to the poker chip tray. The bezel portion of the device herein achieves this goal by providing a conventional multi-card delivery shoe at the surface of a table which is continuously and automatically loaded by a unique shoe loading mechanism. The conventional shoe is located closely proximate of the input portal and control panel, thus achieving convenience and economy of the dealer's motions. Up to four decks may be randomized and verified by an inspection station within the card handling device prior to initiating a card game.

A third goal of the SECURE SHUFFLER WITH SHOE is to disclose a simple reliable mechanical shuffler that can overcome the problems that prevent sustaining continuous game play when faced with the detection of an unreadable card, such as a flipped card, where a flipped card is defined as a card whose face (surface having rank and suit indica) is oriented in the opposite direction as intended. What is needed is a reliable, simple and compact card handling device and method that allows an operator to optionally remedy flipped cards on the fly without stopping or interrupting the ongoing shuffling operation, thus facilitating continuous play at a casino table with securely interrogated cards.

The device and method of an embodiment of the present invention utilizes an automatic shuffling apparatus which includes one card input portal and two discharge portals. The first discharge portal comprises a conventional shoe that receives a continuous supply of randomized cards for use in a subsequent card game. The second discharge portal receives a faulty card (unexpected or unreadable card) from within the device immediately after it passes an optical reading station. In the often encountered case that the card is unrecognized merely because it is flipped, the device operator may immediately re-insert the card into the input portal in a proper orientation without interrupting the ongoing shuffling operation, thereby avoiding the need to delay or abort the shuffling operation.

The device is particularly useful for speeding up dealer hosted card games where a dealer issues randomized (shuffled) cards one-by-one from a shoe. One exemplary use of the device is for assisting a dealer in executing rounds of Double-Deck Blackjack where two decks are mixed together, shuffled and thereafter issued face down to each player from a shoe.

The unique features, compact delivery shoe, and cost efficiency advantages of the SECURE SHUFFLER WITH SHOE will become better understood with reference to the descriptions, drawings and claims which are presented below.

BRIEF DESCRIPTION OF THE DRAWINGS

FIG. 10 is a perspective view of a prior art shuffling device.

FIG. 11 is a perspective view of a conventional prior art dealing shoe.

FIG. 26 is an isometric view of the elevator configuration of the device being claimed herein.

FIG. 27 is a planar view of the gripping arm mechanism of the device being claimed herein.

DETAILED DESCRIPTION OF THE EMBODIMENTS

Figure 1:
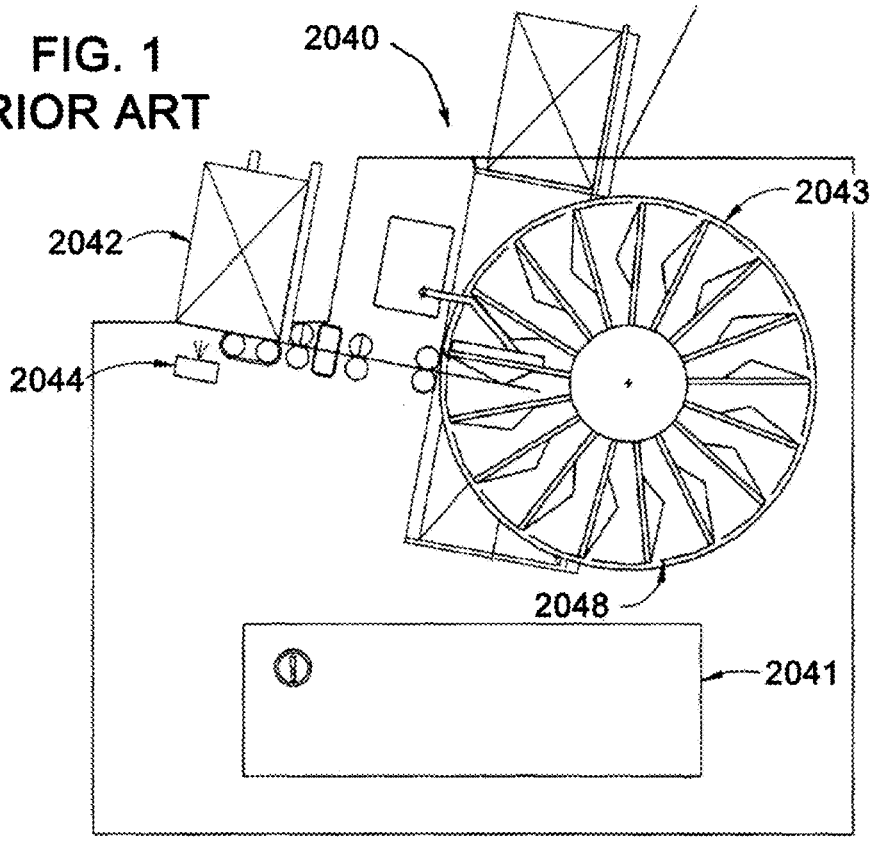
FIG. 1 PRIOR ART
FIG. 1 is a side elevation view from a prior art shuffling device disclosure having an optical inspection station.
Figure 2:
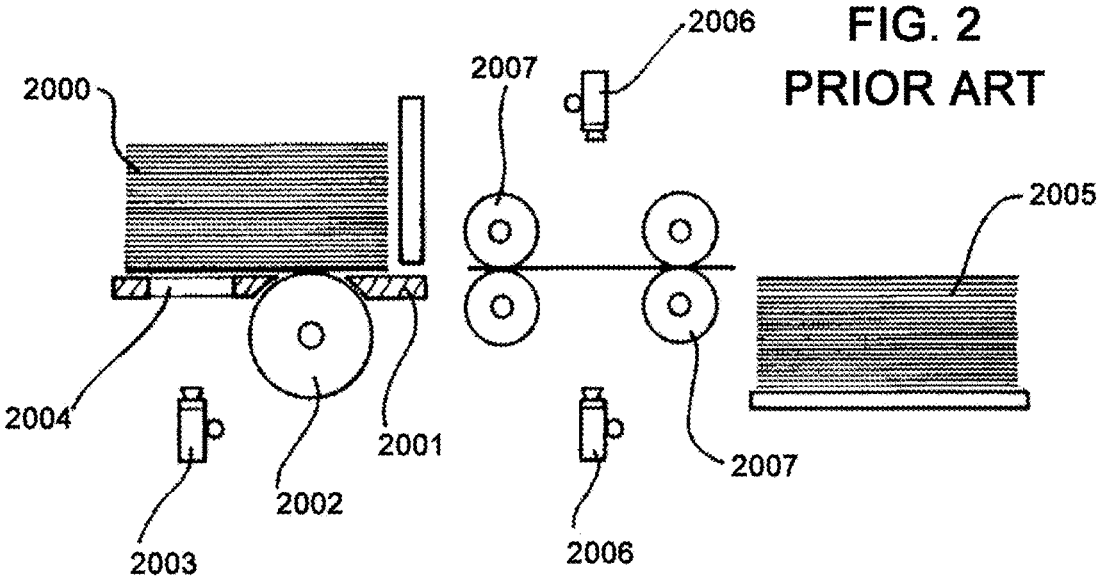
FIG. 2 PRIOR ART
FIG. 2 is a diagram from a prior art disclosure explaining positions for interrogation cameras.
Figure 3:
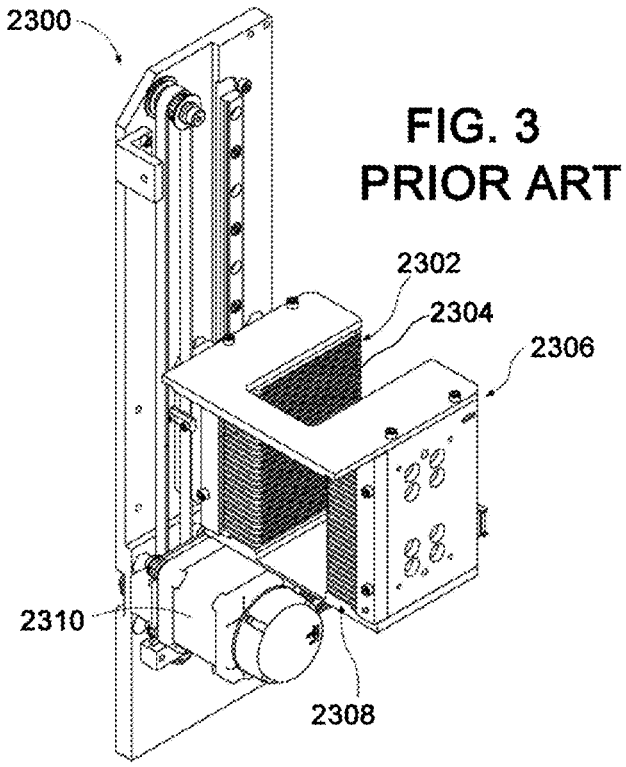
FIG. 3 PRIOR ART
FIG. 3 is an isometric view from a prior art shuffling device disclosure having an elevator with narrow slots.
Figure 4:
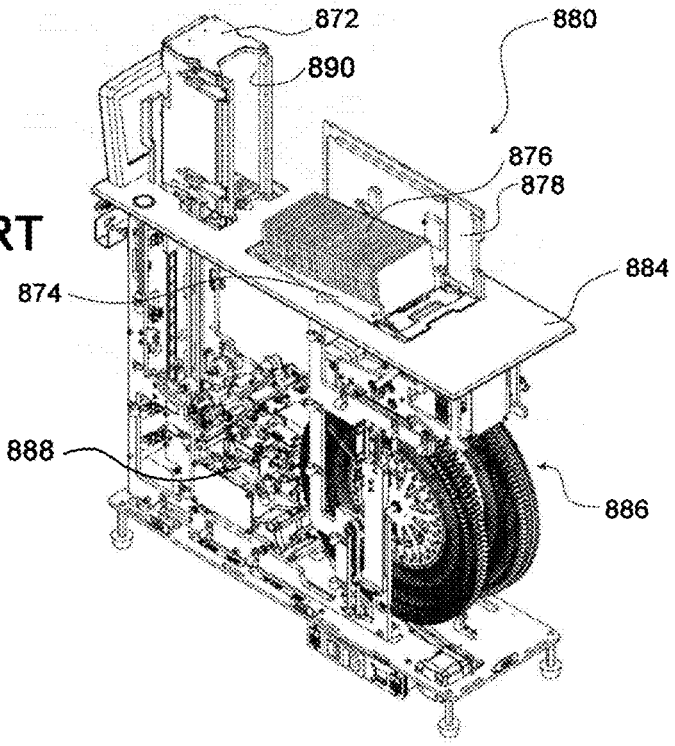
FIG 4. PRIOR ART
FIG. 4 is an isometric view from a prior art shuffling device disclosure which stores flipped cards in one particular compartment of a carousel.
Figure 5:
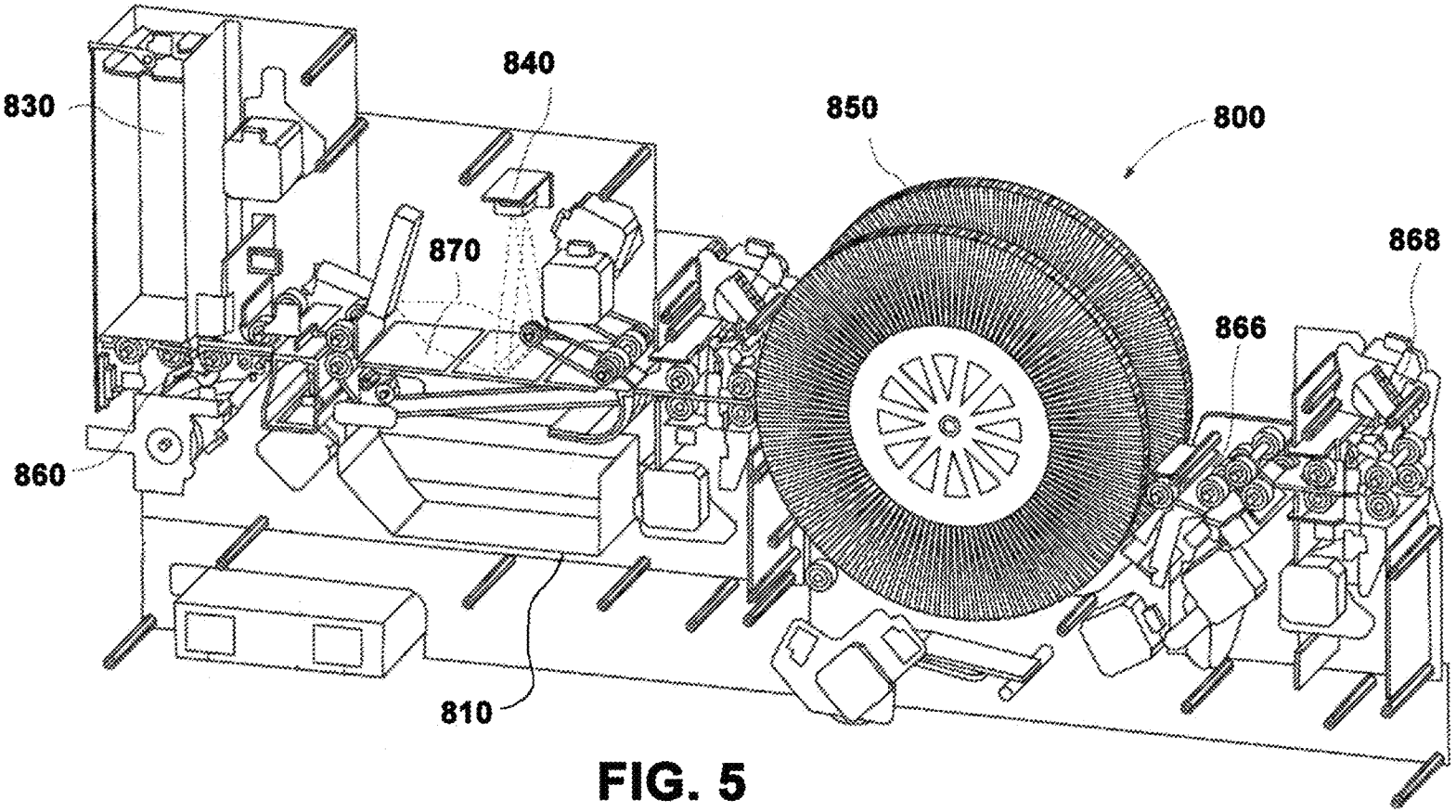
FIG. 5 PRIOR ART
FIG. 5 is a perspective view from a prior art shuffling device disclosure which diverts unreadable cards to a vault.
Figure 6:
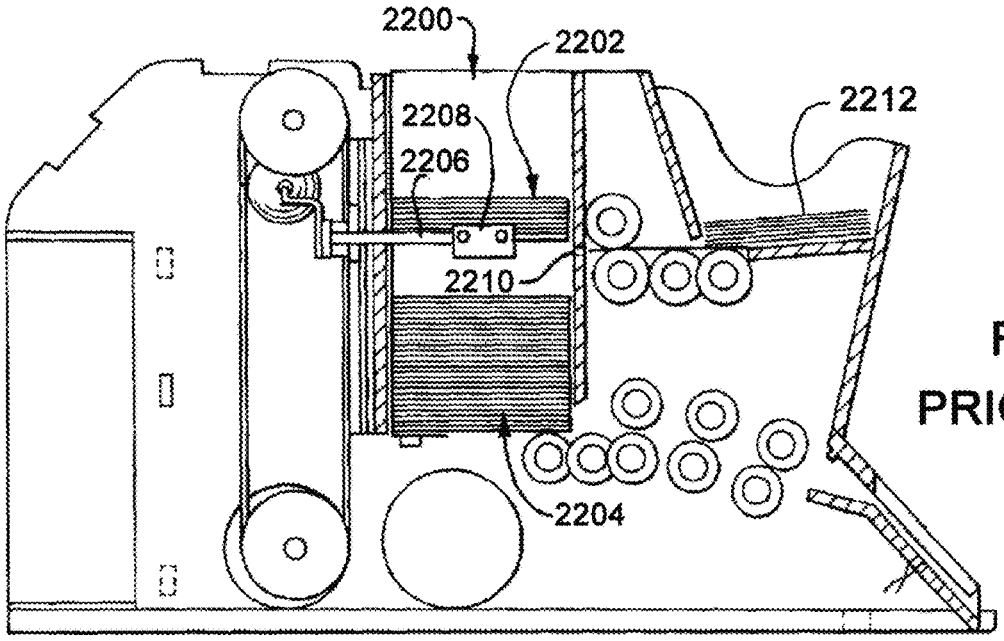
FIG. 6 PRIOR ART
FIG. 6 is a side elevation view from a prior art shuffling device disclosure which uses a pair of gripper arms to grasp stacks of cards.

A casino-grade card handling device for automatically shuffling and verifying one or more card decks simultaneously is described. A conventional multi-card shoe functions as a first discharge portal and resides unobtrusively upon a casino table surface while the bulk of the randomizing portion of the device resides below the table surface. A second discharge portal resides below the table surface and functions to receive individual faulty cards which fail to pass a microcontroller's inspection criteria. The microcontroller utilizes an interrogation sensor to decide the destination of each card, whereupon appropriately identified cards are accumulated and moved to the first discharge portal and "faulty cards" are immediately discharged to the second discharge portal.

For purposes of this explanation, the term "unshuffled deck or decks" is defined as a deck or decks of cards in need of being shuffled (randomized) and verified. The term "accumulated randomized stack" is defined as a stack of cards that has been transformed from an "unshuffled deck or decks" into a randomized stack by a randomizing mechanism. Each and every card in the "accumulated randomized stack" is supported by an adjacent card with the exception of the bottommost card. The term "substack" is defined as a stack of cards having more than two cards but less than a 52 card deck. In one embodiment herein, cards are moved into the shoe in substacks each comprising 18 cards.

The term "verification sensor" is defined as a sensor that can interrogate a playing card for interpretation by a microcontroller. In one form, a verification sensor may merely detect a mark or indicia on a card as it moves along a card path such that the microcontroller can confirm that the card belongs to a set. In more sophisticated forms, a verification sensor may take the form of a miniature camera that can photograph the indicia's of a passing card such that a microcontroller can interpret its suit and rank as is known in the art. The definition of a "fault criteria" is the criteria used by a microcontroller to determine the suitability of a card after interpreting the "verification sensor". In its simplest form, a "fault criteria" may be the number of cards that have passed the "verification" sensor within a given operational span.

The definition of an "unexpected card" is a card that is detectable by the interrogation sensor but does not belong to a set. An "unreadable card" is a card whose expected indicia or mark cannot be read by the interrogation sensor. Cards having indicia's obscured by food or drink residue are examples of unreadable cards. Cards that have been "flipped" such that their identifying indicia faces away from the sensor are further examples of unreadable cards. Flipped cards result from failures by a dealer to arrange each card in front-face to back-face orientation after sweeping spent cards from the table. Flipped cards are the most commonly encountered cause of unreadable card problems. "Faulty cards" include "unexpected cards", "unreadable cards", and "flipped cards".

"Faulty cards" which constitute fault criteria trigger the microcontroller in the device described herein to immediately discharge such cards to the second discharge portal. A "verified group" is a group of one or more decks that have passed through the card handling device while avoiding the microcontroller's fault criteria after interrogation by the "verification sensor". Similarly, the microcontroller identifies a "randomized accumulated stack" as a plurality of cards that have been shuffled and successfully avoided the microcontroller's "fault criteria" after interrogation by the "verification sensor".

It is understood that the "fault criteria" utilized by the microcontroller in the card handling device described herein can be adjusted according to the sophistication of its "verification sensor", where the sophistication of that sensor is a designer's choice from amongst the many types of optical interrogation sensors that are known in the art.

Figure 17:
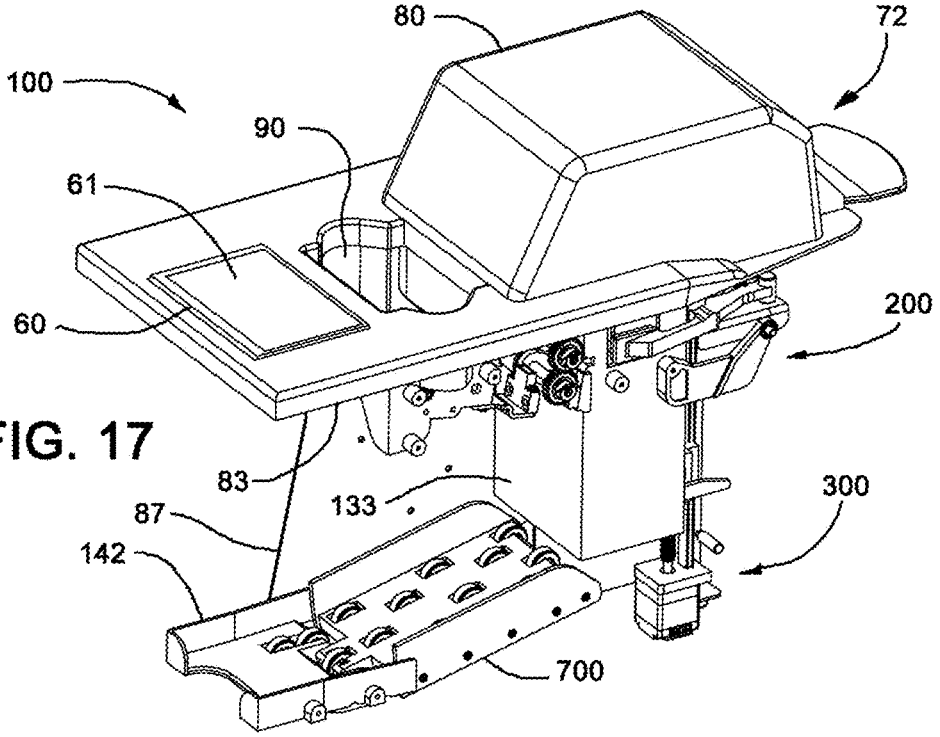
FIG. 17 is an isometric view of the card handling device being claimed herein.
Figure 18:
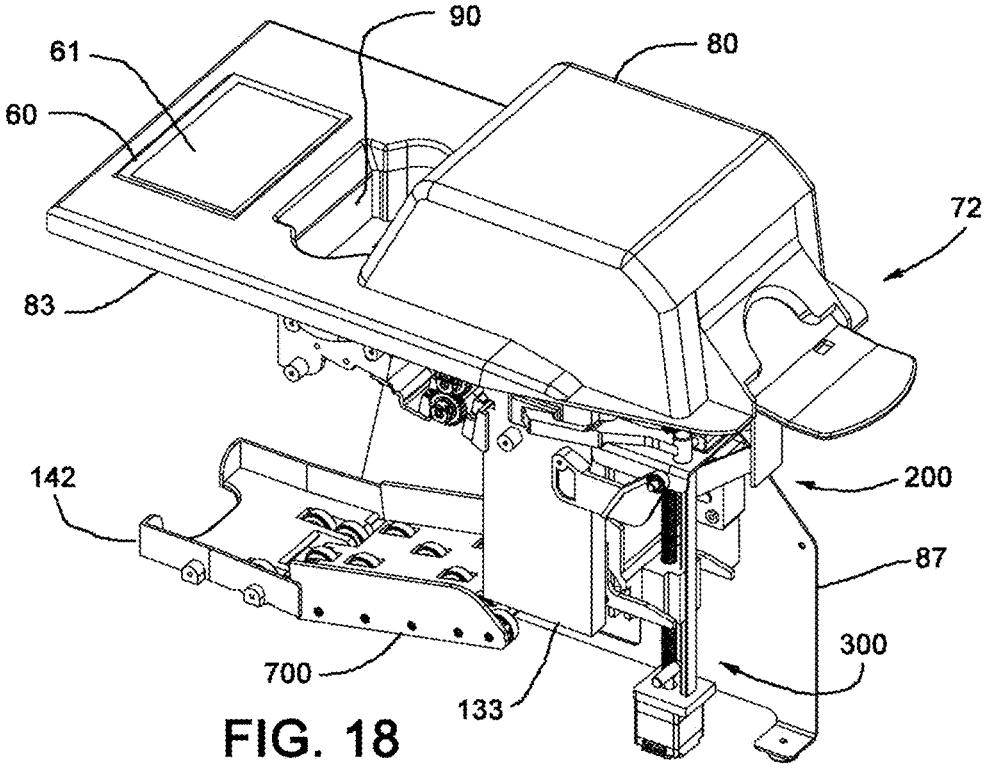
FIG. 18 is another isometric view of the card handling device being claimed herein.

FIG. 17 and FIG. 18 illustrate isometric views of a preferred embodiment of the card handling device disclosed herein. The card handling device 100 possesses an injection molded bezel 80 and a control panel 60 having a touch screen 61 which is positioned conveniently for a casino dealer on the exterior of the bezel. The device is structurally supported by a pair of side frames 87 which provide structural support for the bezel 80. At least one microcontroller (not shown) controls the operation of the device, including operation of the touch screen. Touch screen 61 is a small 5-inch touchscreen that is used to program the device for various card games. For size reference, a 5-inch touchscreen is slightly smaller than the smaller touchscreens used in today's mobile phones. Prior to each game, the dealer will utilize the touch screen 61 to program the device for various operational modes and game parameters. The touchscreen will also indicate possible malfunctions and security issues to the dealer. For example, the microcontroller may perform various security checks as the cards pass through an inspection station and will issue a warning on the touch screen if an inspection criteria is violated. In a most primitive example, an inspection criteria may be the expected number of cards passing through the inspection station during certain initializing or shuffling operations.

Card input portal 90 is designed to receive and hold multiple decks of unshuffled cards. Upon the command of a dealer or upon a sensor condition, those cards are transported individually into a randomizing chamber wherein each card is placed into a random position in an accumulating stack of cards that are supported upon an elevator. One side frame and some support bracketry have been made transparent in FIG. 17 and FIG. 18 for the purpose of viewing the internal mechanism which includes a randomizer housing 133 which houses an internal randomizing mechanism. An elevator mechanism 300 is located directly below the randomizer housing 133, and a card transport track 700 is shown sloping away from a lower portion of a randomizer housing 133. A discharge tray 142 resides at the end of the card transport track and constitutes the second discharge portal.

A multi-card shoe 72 comprises the first discharge portal, having the function of receiving a continuous supply of randomized (shuffled) cards from the randomizing chamber below. When the randomizing mechanism has accumulated a stack of randomized cards, the elevator raises that stack to the upper region of the randomizer housing. A shuttle mechanism thereafter skims substacks of randomized cards from the elevator and into the shoe cavity. A plurality of cards are continuously maintained within the shoe, which is automatically refilled as conditioned by a sensor which counts cards that have been removed from the shoe.

The device is designed to be embedded within a casino table surface or an adjacent stand and possesses a bezel mounting surface indicated by surface 83 which functions as the device mounting surface. When embedded, only the bezel 80 is visible above the table surface and the bulk of the device resides below the bezel, thus assuring that the device is an unobtrusive occupant of the casino table surface.

Figure 19:
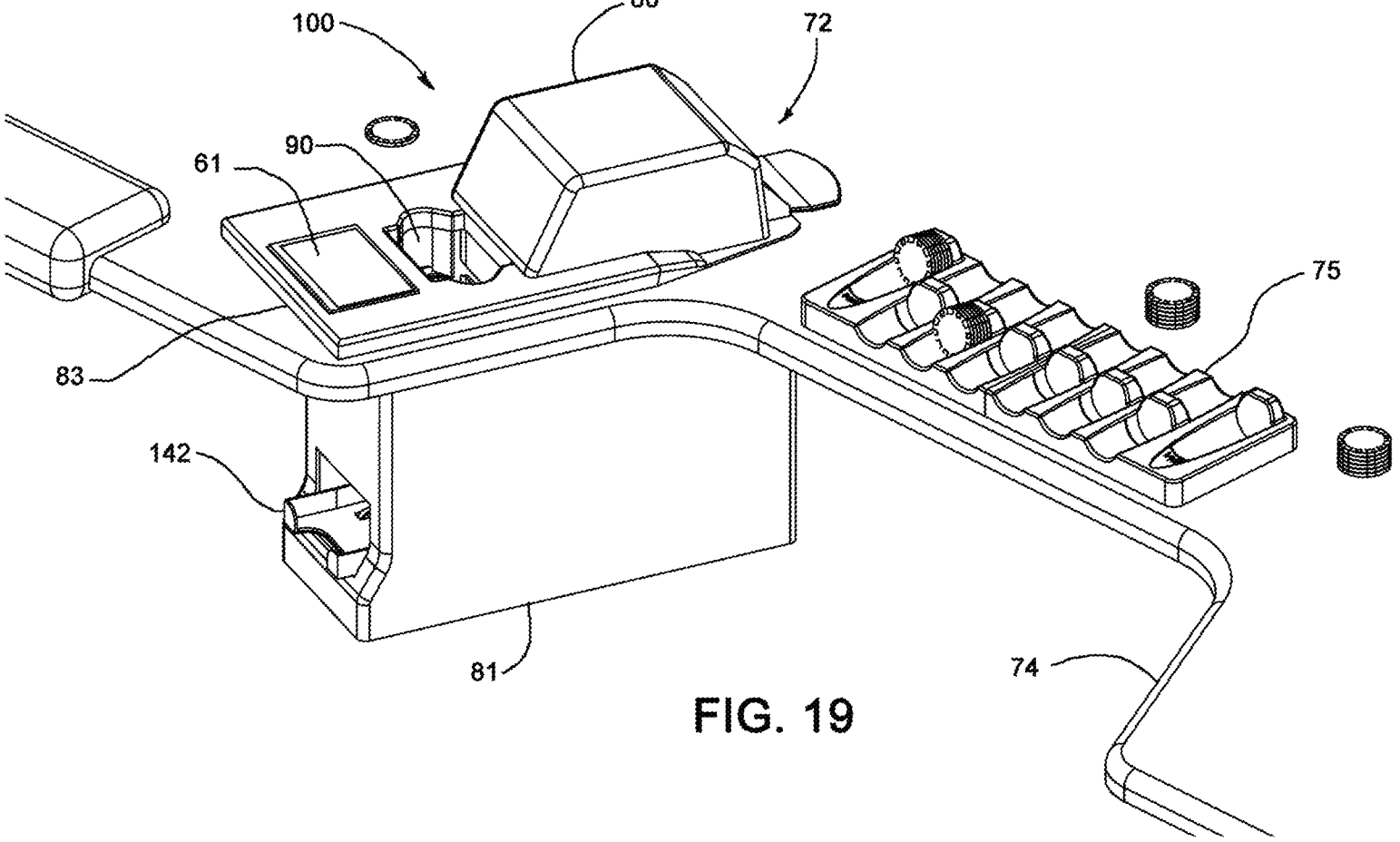
FIG. 19 is a perspective view of an embodiment of the card handling device being claimed herein as it would appear in embedded within a casino table.

FIG. 19 illustrates a preferred embodiment of the card handling device 100 as it would appear embedded within a casino table. This illustration depicts a common type of casino table 74 having a recessed opening in which the dealer stands while overseeing the game. The device 100 is embedded conveniently withing the operator's reach and unobtrusively resides adjacent to the chip tray 75. Shuffled cards are continuously delivered to the multi-card shoe 72 which resides at the table surface. The closely clustered arrangement of the touch screen, input portal, and shoe allows easy access and economy of motion for the dealer.

Figure 20:
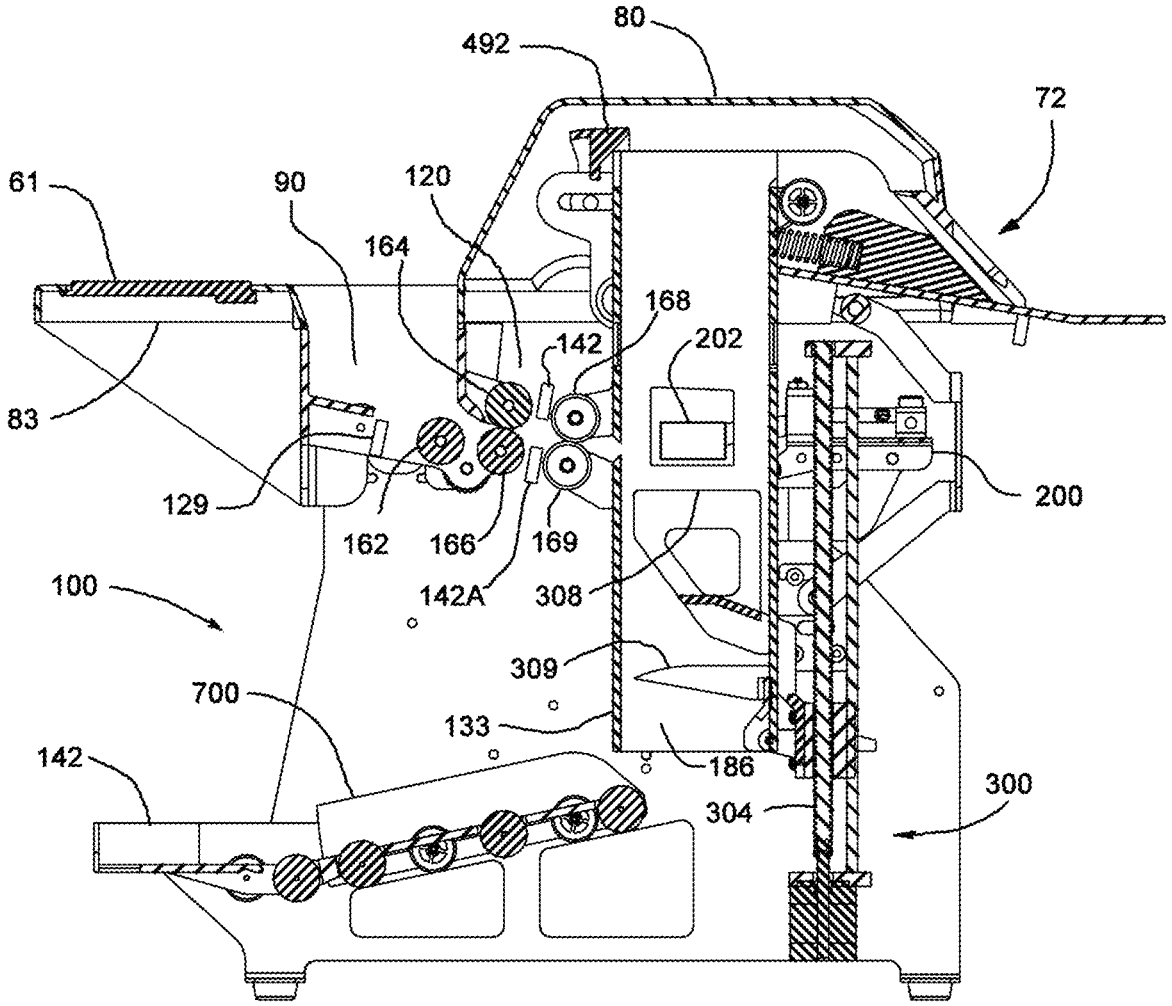
FIG. 20 is a side elevation section view of an embodiment of the card handling device being claimed herein.

The anatomy of the device 100 is briefly explained by the section view shown FIG. 20 where the nearest side frame 87 is not shown for the purpose of illustration. There are four major subassemblies shown in these two figures, including the card transport 120, the elevator assembly 300, the shoe assembly 72 and the discharge track 700.

The input portal 90 is shown near the top left of the view. Feed rolls 162, 166 and 164 are utilized to move individual cards past an interrogation sensor 142A, and additional feed rolls 168 and 169 move individual cards into the randomizer chamber 186. The housing 133 possess four walls which contain card decks with slight clearance around the periphery, thus forming the randomizing chamber 186. After the deck is randomized and successfully verified, an elevator surface 308 lifts the accumulated randomized stack to the upper region of the randomizer chamber whereupon a shuttle 492 skims a substack from the accumulated randomized stack and moves it into the shoe 72. In the event that an individual card is found to be faulty after interrogation by sensor 142A, the microcontroller moves that card to surface 309 of the elevator. The faulty card is thereafter lowered to an elevation where it is discharged along discharge track 700 to the discharge tray 142.

Figure 21:
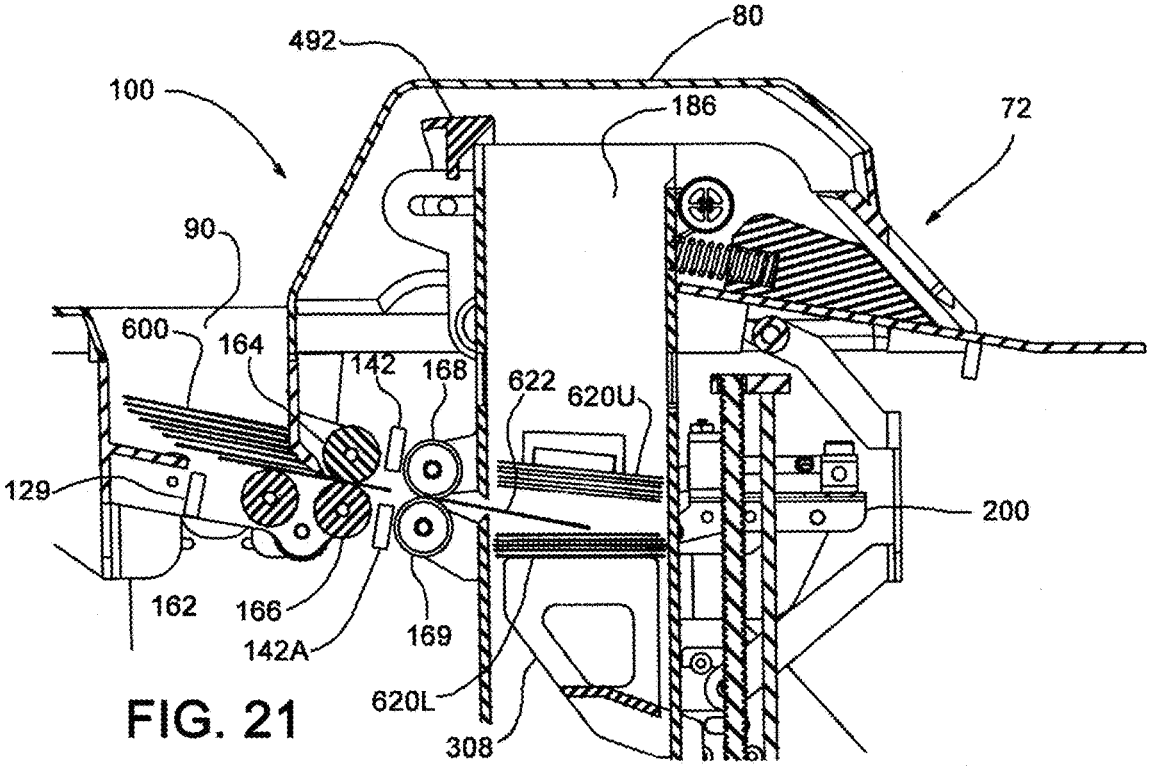
FIG. 21 is a partial side elevation section view of the card handling device being claimed herein showing a card entering the randomization chamber.
Figure 22:
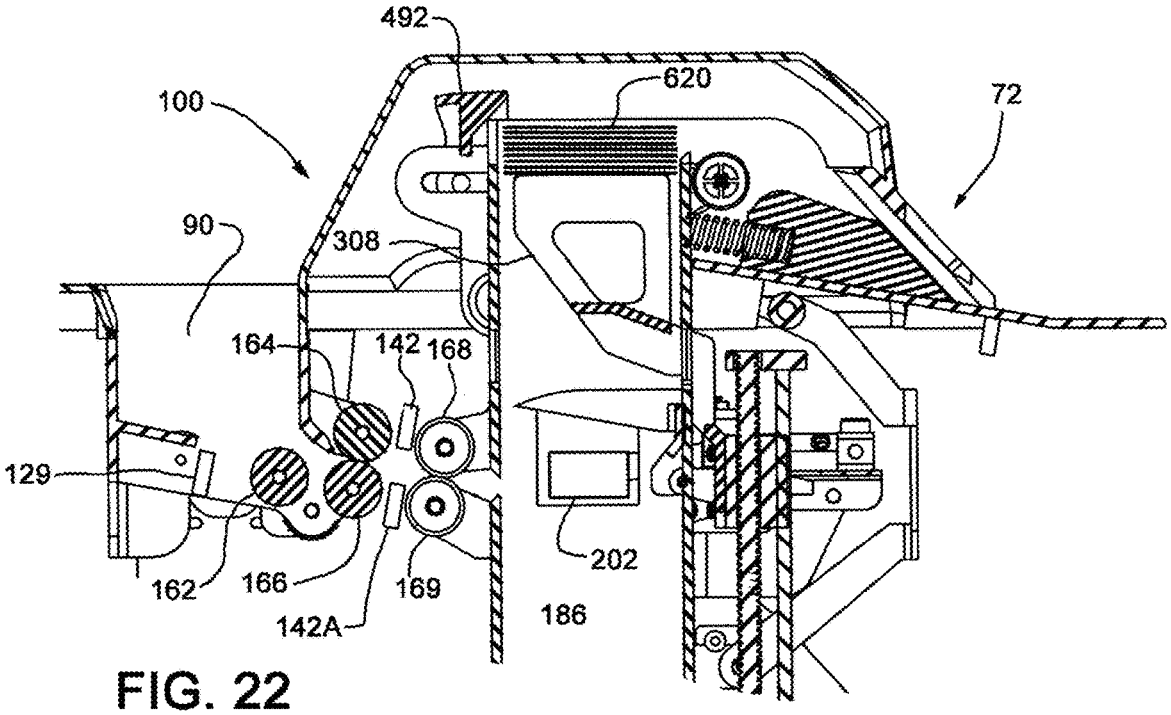
FIG. 22 is partial side elevation section view of the card handling device being claimed herein showing an accumulated randomized stack raised to the top of the randomizing chamber.

A more detailed explanation can be observed from FIG. 21 and FIG. 22 which explain the movement of non-faulty cards within and through the card handling device 100. FIG. 21 shows a new or spent supply of unshuffled cards 600 located in the input portal 90 with the face (indicia side) of the cards facing downward. When the dealer activates a SHUFFLE command on the touchscreen 61, the microcontroller interrogates sensor 129 to determine if any card is present in the portal. If a card is present at sensor 129, the microcontroller will activate motors (not shown) that rotate feed rolls 162, 166 and 164 until the leading edge of a card is detected by optical recognition sensor 142.

Referring to FIG. 21, an unshuffled card 622 has moved past the sensors 142 and 142A and into the randomizing chamber 186, where the card stack 620 is supported by elevator 308. The microcontroller activates a stepper motor (not shown) to rotate feed rolls 168 and 169 which feed the card into the randomizing chamber through a slot in the housing 133. The optical interrogation sensor 142A is utilized to read the rank and suit of each card. Optical sensor 142 is used to time the movement of the individual cards through the feed rolls, in addition to counting the cards in the deck. Sensor 142A may be any optical recognition sensor as taught in the prior art, including a digital camera, CMOS camera, color pixel sensor, Contact Image Sensor (CIS) or a CCD image sensor. In the preferred embodiment, a CIS is used to read the rank and suit in the upper right corner of each card. This optical recognition process will continue until sensor 129 signals that no more cards are available in the input portal 90.

The randomizing cycle will be explained below. After the randomizing cycle is completed the elevator 307 will raise the accumulated randomized stack to the upper region of the randomizing chamber 186 as shown in FIG. 22. A shuttle mechanism will thereafter activate a shuttle 492 which will skim a substack from the accumulated randomized stack and seat that substack into the shoe 72.

Figure 23A:
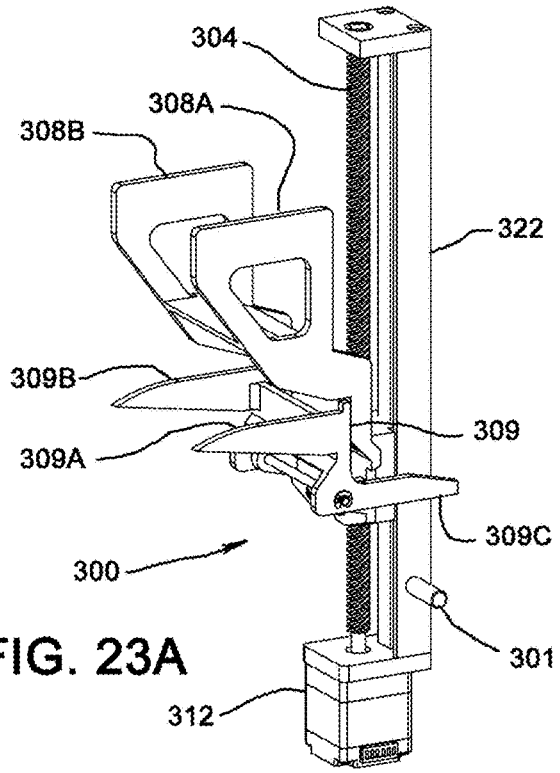
FIG. 23A, FIG. 23B, FIG. 24A and FIG. 24B are isometric views of the elevator configuration of the device being claimed herein.

The randomizing chamber 186 in FIG. 20 possesses an elevator carriage which is configured with two supports for transporting 1) card stacks and 2) a single card which has been identified as faulty. The structure of the elevator assembly 300 and its driving means is shown in FIG. 23A. The elevator assembly 300 has an injection molded plastic elevator carriage 308 which comprises a first card support and a second card support each having two arms. The first card support is configured with two arms 308A and 308B which constitute support 308 which is designed to support a stack of cards. The second card support is configured as a rotating fork 309 having two arms 309A and 309B which are designed to carry a single card. The rotating fork 309 is attached to the carriage 308.

The elevator carriage 308 moves vertically by motion of a lead screw 304 which is driven by step motor 312. The carriage 308 supports card stacks as they are moved vertically within the randomizing chamber 186 while the support arms 309A and 309B are designed to support a single faulty card. The arms 308A and 308B and the arms 309A 309B penetrates the randomizing chamber 186 through access slots 337 (see FIG. 30) in the chamber wall 133 of the randomizing chamber 186, such that the elevator supports may move freely in a direction parallel to the chamber walls.

Figure 23B:
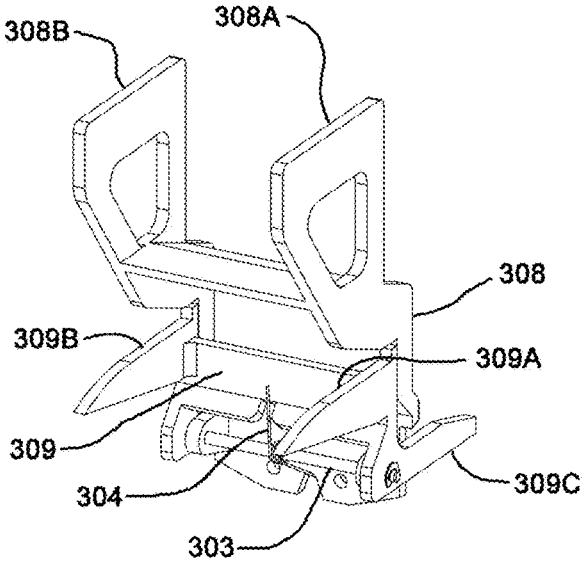

FIG. 23B shows the configuration of carriage 308 in more detail. The rotating fork 209 pivots upon shaft 303 and is normally retained by torsion spring 304. A projecting arm 309C extends from the rear of the rotating fork 309 and is used to actuate rotation of the fork which is opposed by torsion spring 304.

Figure 24A:
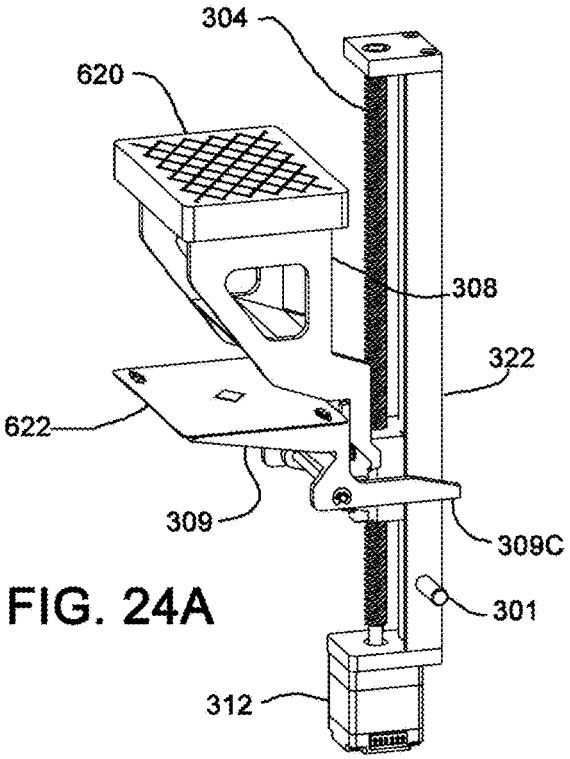

The orientation of an accumulated randomized stack 620 is shown mounted upon the first support arms when in transit upon the elevator carriage 308 in FIG. 24A. During randomization, the carriage 308 oscillates vertically such that the card stack 620 can be split at various random locations in order to create an opening for inserting a new card into the stack (explained below). As shown in FIG. 24A, a faulty card (Ace of diamonds) is shown mounted upon the support arms 309A and 309B which are designed to support a single card. The faulty card is shown face-up such as to illustrate the exemplary case where a flipped card has been encountered. The cards residing on both elevator carriage supports are loosely constrained laterally on four sides by the chamber walls of chamber 186 such that they move freely with the elevator supports.

Figure 24B:
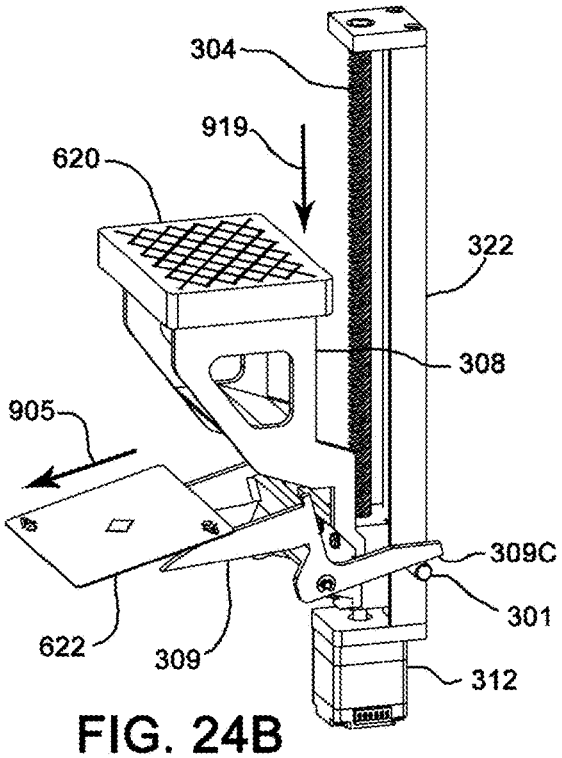

FIG. 24B illustrates the rotatable fork 309 in its rotated state when a force acts upon its projection 309C. This rotation is designed to induce centrifugal force upon a card while ejecting the card which is carried upon arms 309A and 309B. Referring to FIG. 24B, a stud 301 is attached to leadscrew frame 322. The rotation of fork 309 is induced by contact with stud 301 as the carriage 308 is lowered by lead screw 304 in the direction of arrow 919. The sudden rotation causes the card 622 to be ejected onto the rolls 742 of the discharge track 700, whereupon inertia carries card 622 in the direction of arrow 905 to the discharge tray 142. The rotating fork support 309 is thus self-actuated by the downward motion of the elevator which alleviates the cost which would otherwise be associated with a motor or solenoid. The second card support is thus a self-actuating support.

Figure 25A:
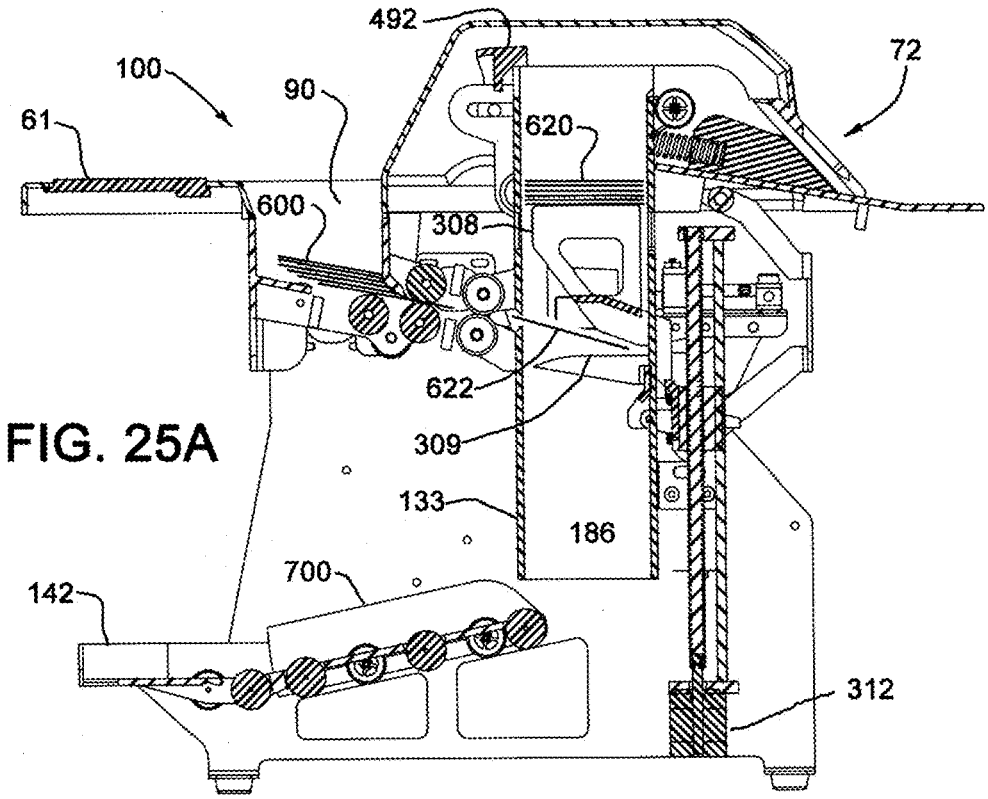
FIG. 25A and FIG. 25B are side elevation views illustrating the ejection of faulty cards as claimed in the device herein.
Figure 25B:
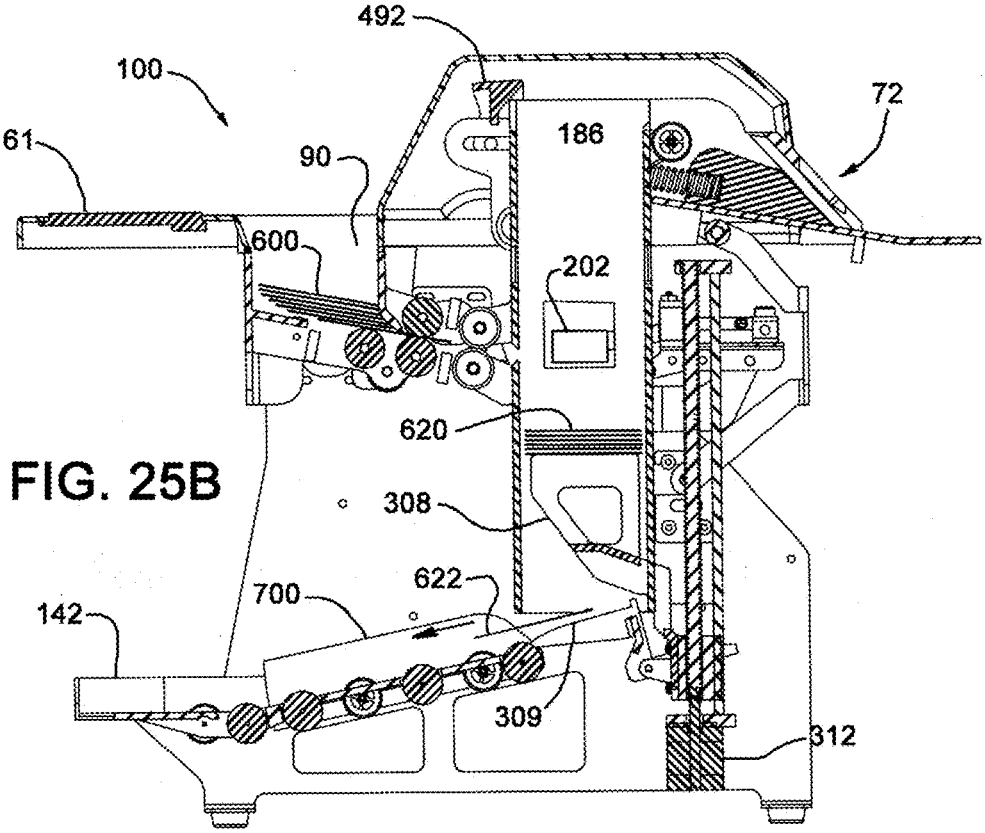

FIG. 25A illustrates the repositioning of the elevator carriage when the microcontroller detects a faulty card during a randomization cycle. The microcontroller repositions the elevator such that a faulty card can be collected upon the elevator arms 309A and 309B. The elevator is thereafter moved to the discharge position shown in FIG. 25B where the rotating fork 309 ejects card 622 onto the discharge track 700. The centrifugal force of the rotating fork creates inertia in the direction of the arrow which carries the card 622 to the discharge tray 142. Thereafter, the elevator immediately rises upward to continue with the randomization cycle that is underway. The dealer (machine operator) is alerted to the faulty card by a message on the touch screen 61.

A faulty card may reside in the discharge tray 142 while the randomization cycle continues. In the case that the faulty card is a flipped card, the dealer may visually identify the flipped card, remove it from the tray 142 and re-insert that card with proper orientation into input portal 90. Other faulty cards may be treated according to rules established by individual casinos.

The randomizing cycle comprises a series of motions performed by the device to sort the individual cards into a randomly arranged stack within the chamber 186. The randomizing cycle will automatically start when the dealer activates the "Shuffle" command as long as sensor 129 detects the presence of a card. Individual cards that avoid the microcontroller's fault criteria are inserted into a growing randomized card stack designated as the accumulated randomized stack.

The randomizing mechanism of the present invention is devoid of narrow slots, carousels, combs, racks, or ejector blades that are previously known to be vulnerable to jamming in other prior art devices that use narrow slotted combs or carousels. Referring to FIG. 26, a section of the card stack being randomized is raised by a gripper mechanism 200 which creates a randomly chosen wedge-shaped opening 326 for oblique insertion of a card from the unshuffled stack, raises an upper sub-stack 620U, and thereafter lowers the upper sub-stack 620U onto the newly inserted card. The large wedge-shaped opening 326 is tolerant of the elevator position (also known as "position tolerant") during card insertion, thereby reducing the vulnerability to bent or warped cards as depicted by card 622 in FIG. 26.

Figure 7:
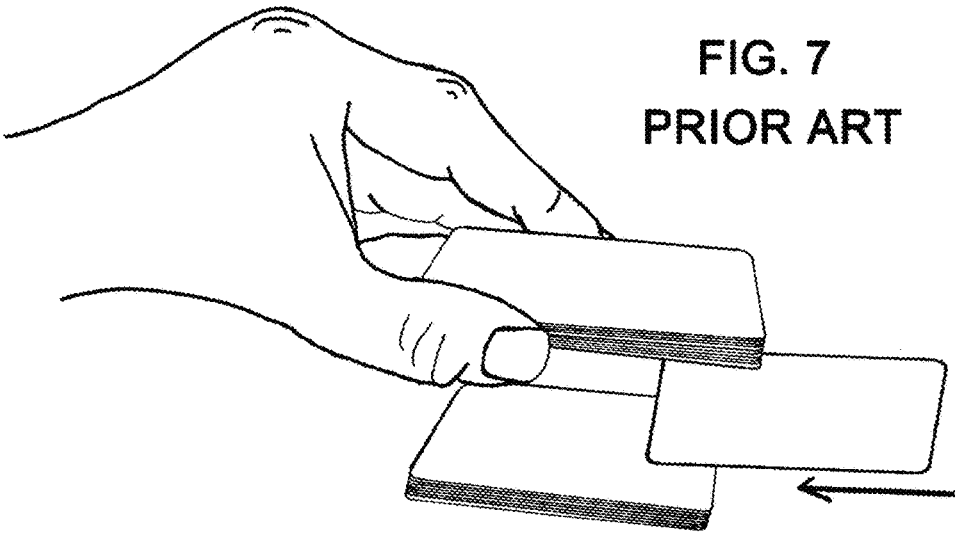
FIG. 7 PRIOR ART
FIG. 7 is a diagram which explains the human action that is emulated by the device in FIG. 6.
Figure 8B:
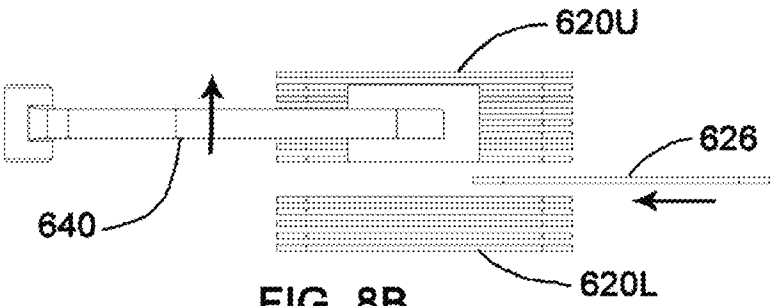
FIG. 8B PRIOR ART
FIG. 8A and FIG. 8B are diagrams which explain the sequence of movements utilized by the prior art gripper mechanism of FIG. 6.
Figure 8A:
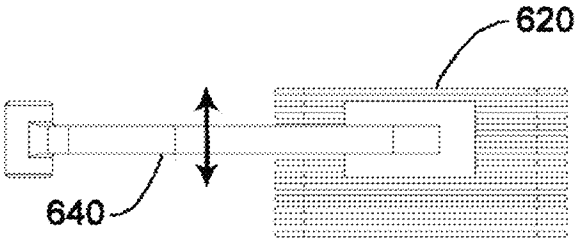
FIG. 8A PRIOR ART
Figure 9B:
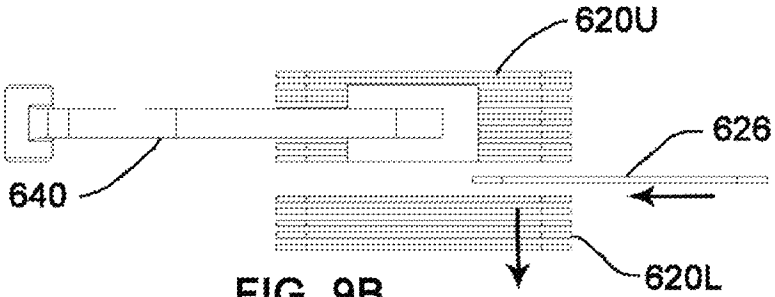
FIG. 9B PRIOR ART
FIG. 9A and FIG. 9B are diagrams which explain the sequence of movements utilized by another prior art gripper mechanism.
Figure 9A:
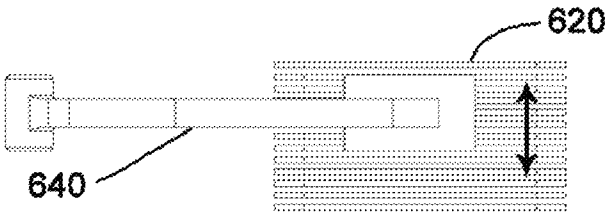
FIG. 9A PRIOR ART
Figure 12:
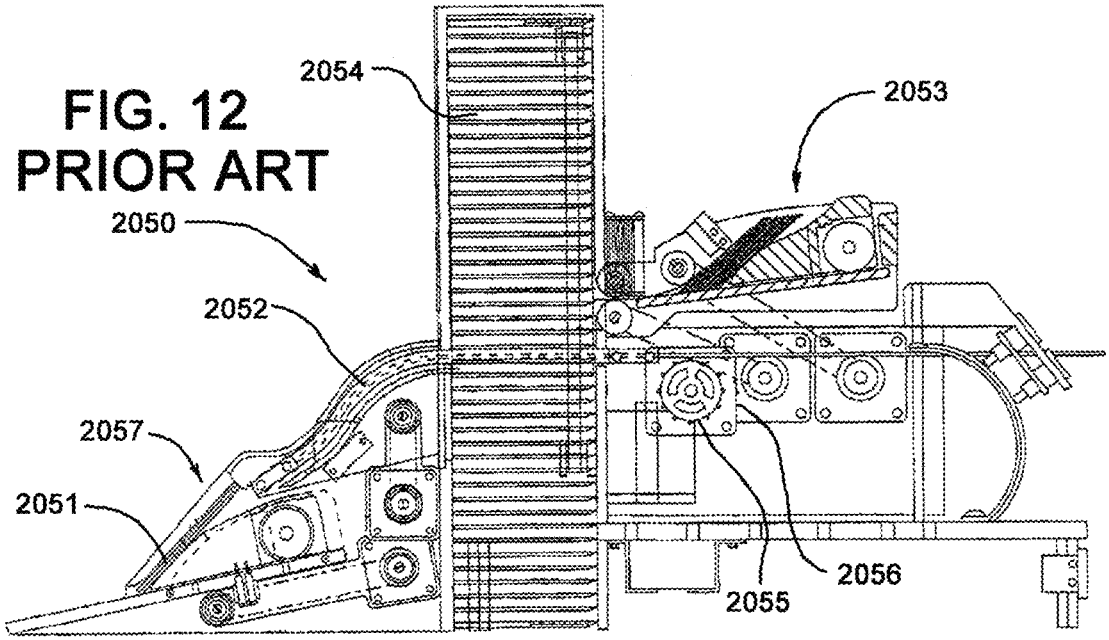
FIG. 12 PRIOR ART
FIG. 12 is a side elevation view of a prior art shuffling device having an integral shoe.
Figure 13:
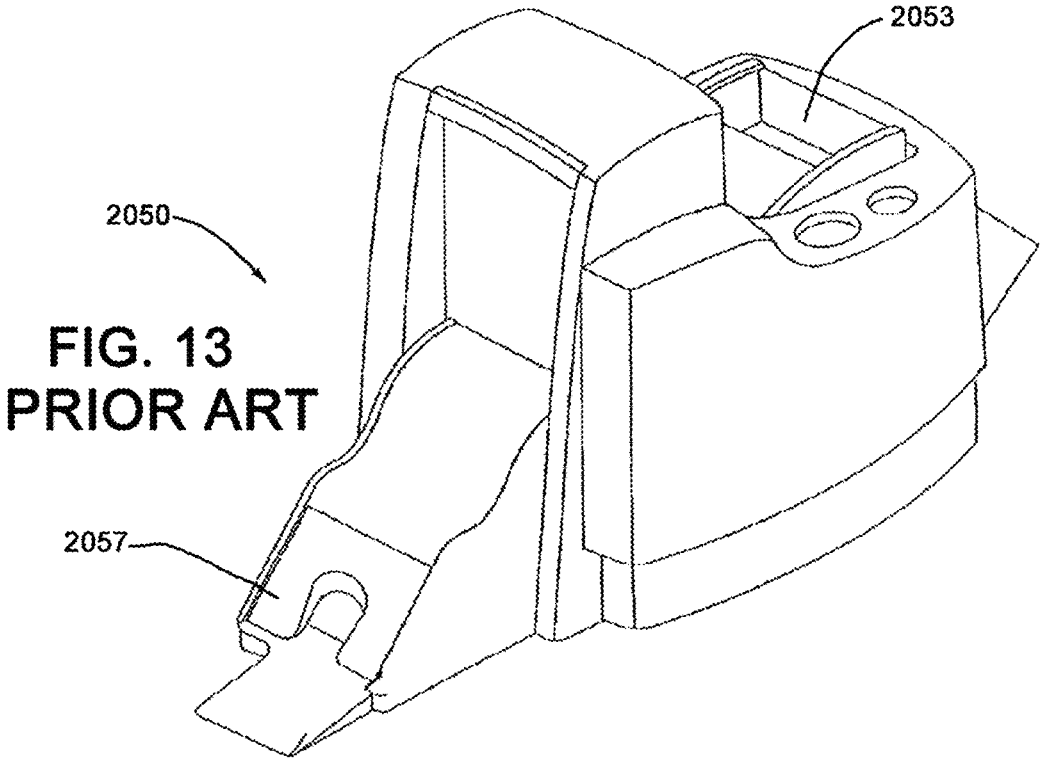
FIG. 13 PRIOR ART
FIG. 13 is a perspective view of the prior art device of FIG. 12.
Figure 14:
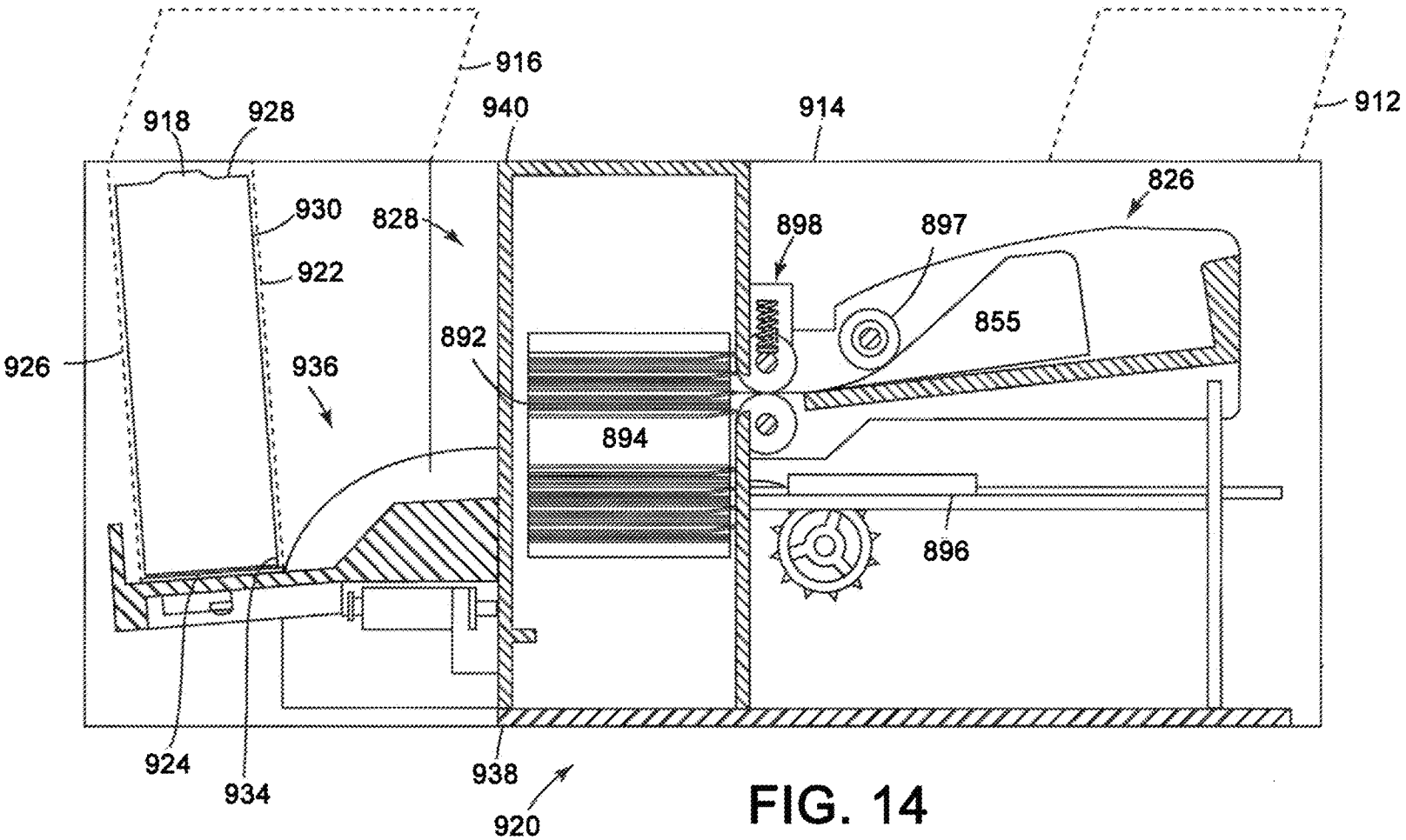
FIG. 14 PRIOR ART
FIG. 14 is a side elevation view of a prior art shuffling device.
Figure 15:
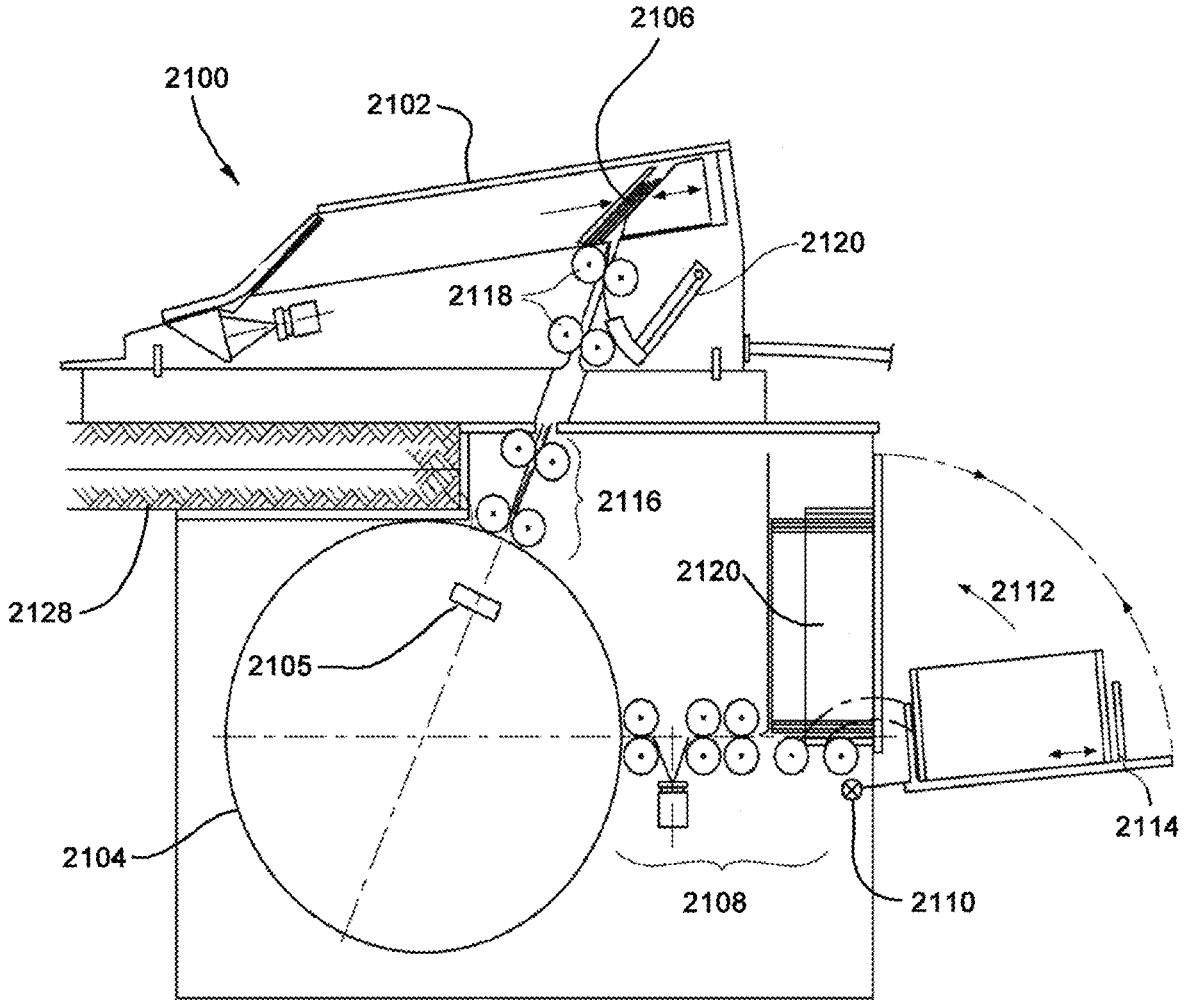
FIG. 15 PRIOR ART
FIG. 15 is a side elevation view of a prior art shuffling device having a carousel and a shoe.
Figure 16:
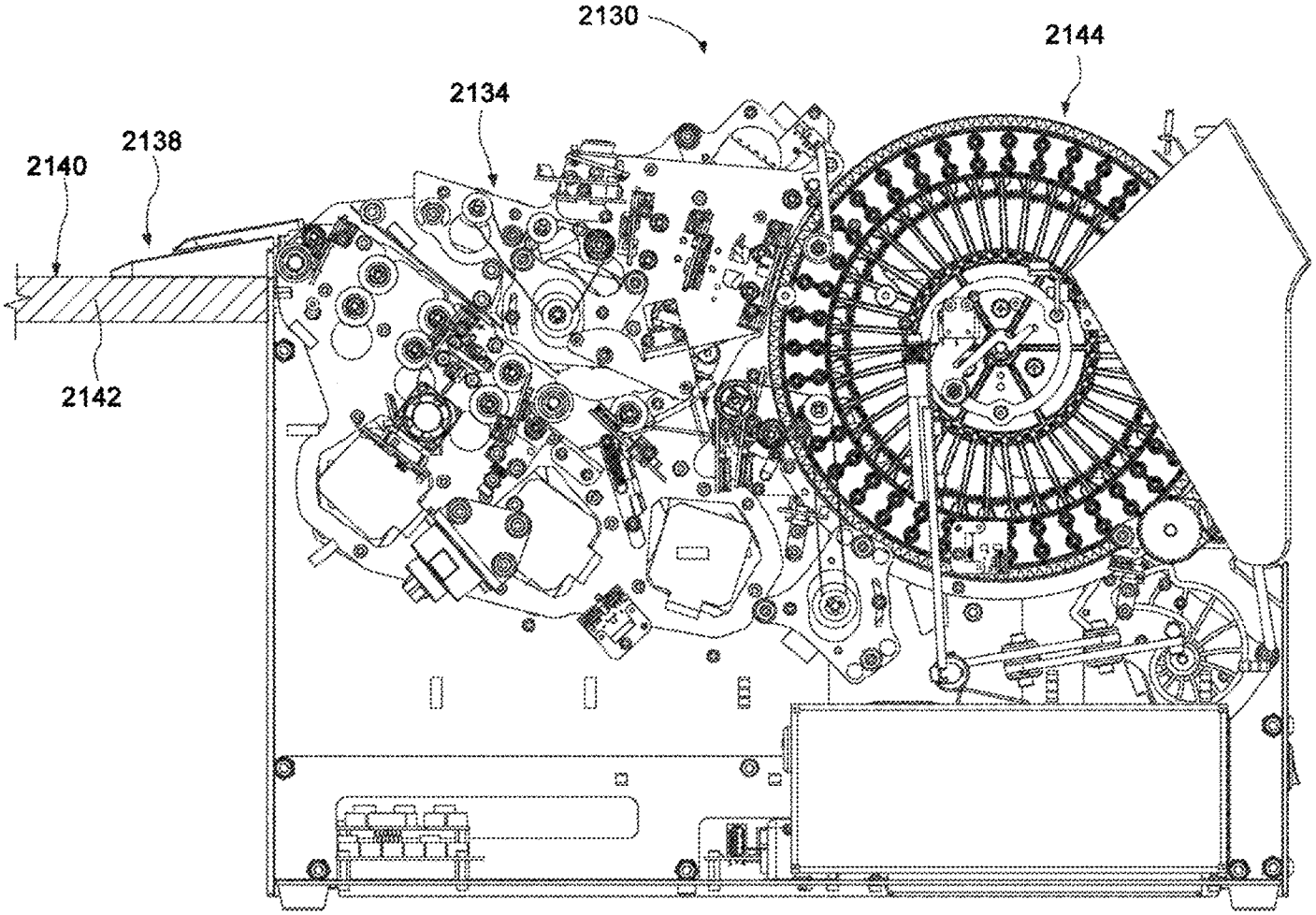
FIG. 16 PRIOR ART
FIG. 16 is a side elevation view of a prior art shuffling device having a carousel and a shoe.

The randomizing method utilized herein also emulates the motion of a human dealer when cutting a card into a card deck as shown in prior art FIG. 7. Referring to FIG. 27, a gripper assembly 200 emulates the gripping motion of a dealer's fingers. Two gripper pads 202 are mounted on the terminal ends of a first gripper arm 203 and a second gripper arm 204, with each pivoting upon pivot screws 206. The two arms are actuated by two small solenoids 207 and 208 which are mounted on the gripper frame 210. When the solenoids are activated, the arms 203, 204 and their associated pads 202 move in the direction of the arrows to pinch the lateral surfaces of a card stack as shown in FIG. 26. Upon deactivation of the solenoids 207, 208, the two arms 203, 204 are moved in the reverse direction by spring 212, which relaxes the grip and releases the card stack 620. In the relaxed position, there exists only slight clearance between the gripper pads 202 and the lateral surface of accumulated randomized stack 620.

Figure 28:
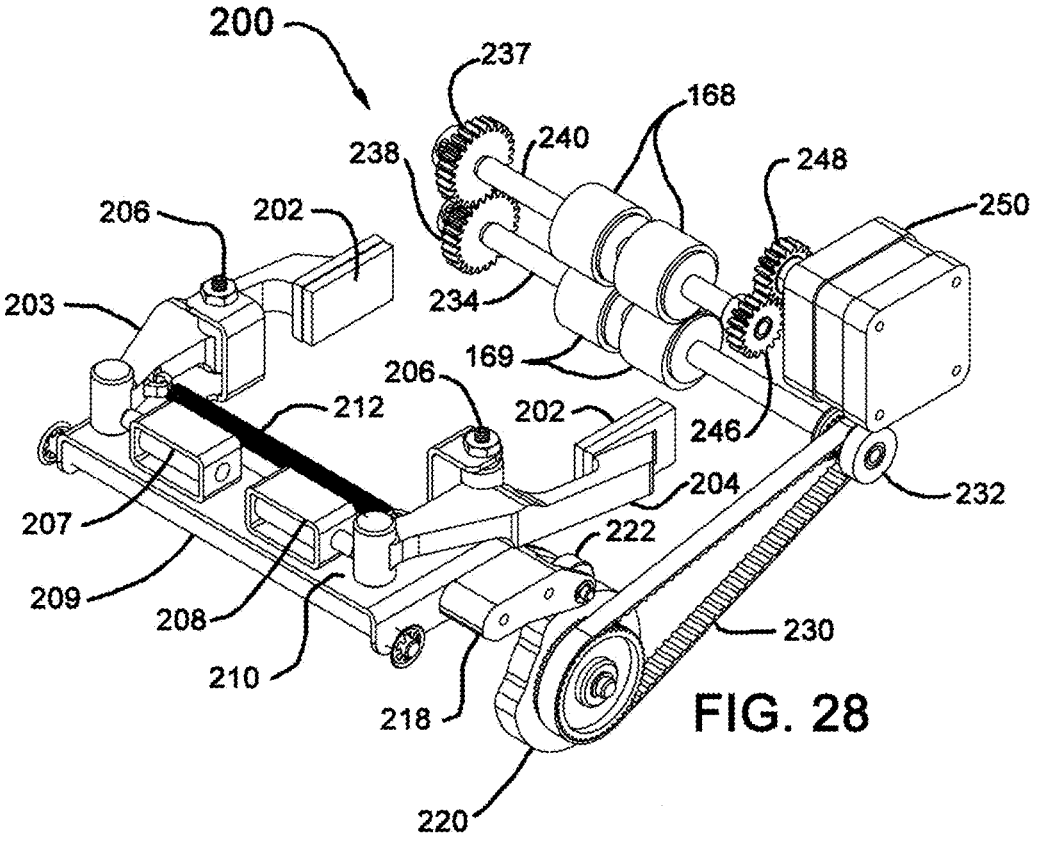
FIG. 28 is an isometric view of the gripping arm mechanism of the device being claimed herein.
Figure 29:
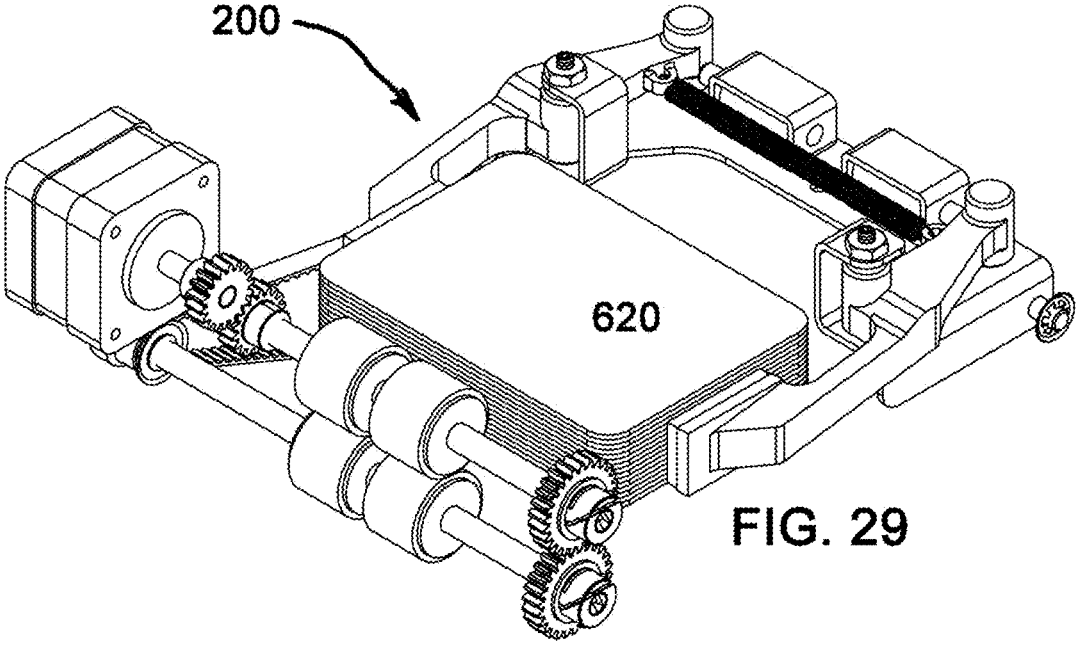
FIG. 29 is another isometric view of the gripping arm mechanism of the device being claimed herein.

The complete gripper assembly 200 is shown in FIG. 28 where the gripper frame 210 is pivotally mounted on a shaft 209. The pivotal mount allows the gripper frame 210, including gripper arms 203 and 204, to move in an arc after the gripper solenoids 207, 208 have been activated. A cam follower roll 222 is mounted to the follower mount 218 which is rigidly attached to the gripper frame 210. During the gripping cycle the card stack 620 is grasped by the gripper arms 203 and 204, and thereafter lifted by the cam 220 to move an upper sub-stack of cards 620U upward through an arc. The motion is illustrated in FIG. 21 where the upper sub-stack is shown as 620U.

The elevator assembly 300 is used to position a card stack relative to the gripper mechanism 200, in order to allow the gripper assembly 200 to split the card stack into two sub-stacks, 620U, 620L. The orientation between the elevated, upper sub-stack 620U, the gripper assembly 200, the lower sub-stack 620L, and the elevator assembly 300 is shown in FIG. 26. A lower card sub-stack 620L is shown supported by the elevator arms 308, while an upper card sub-stack 620U is shown lifted in an arc about pivot P4 which is locationally fixed to the frame of card handling device 100. The vertical position of the split between the upper sub-stack 620U and the lower sub-stack 620L is determined by the microcontroller which relocates the elevator carriage 308 just prior to the gripping cycle. As shown in the isometric view of FIG. 26, the elevator arms 308 position a card stack 620 in a randomly selected elevation and the gripper assembly 200 thereafter splits the card stack through an arc at the random location. The lower sub-stack 620L is held stationary by the elevator arms 308 while the gripper arms 203, 204 raise the upper sub-stack 620U, and while a new card 622 is inserted into the wedge-shaped opening 326 (FIG. 26). As illustrated in FIG. 26, the axis of the elevator may form an angle with the surface of the casino table that is other than perpendicular.

The purpose of the cam 220 shown in FIG. 28 is two-fold. First, the gripper assembly 200 creates a large wedge-shaped opening 326 which is tolerant to curved or bent cards as illustrated by warped card 622 in FIG. 26. The large wedge-shaped opening 326 overcomes the jamming problem exhibited by prior art narrow slot carousel and moving comb shuffling devices shown in FIG. 3, FIG. 4, FIG. 5 and FIG. 12. Secondly, the cam 220 is designed to alleviate the cyclic life burden on the components of the elevator assembly 300. The prior art devices that utilized gripper mechanisms (see prior art FIG. 8A through FIG. 9B) required three elevator motions for each card insertion; a first elevator motion to arrive at the splitting plane; a second elevator motion to split the deck into two sub-stacks; and a third elevator motion to merge the two sub-stacks together after each card insertion. For one deck of 52 cards, for example, the prior art elevators must shuttle through 156 (3×52) motion cycles. In contrast, the elevator assembly 300 of the embodiments herein relocates just once during each card insertion cycle, thereby extending the service life of the elevator assembly 300 as compared to the prior art.

The previously described grasp-elevate-insert-release cycle is repeated for each of the cards in the input portal 90 until all cards have been transferred to the card stack 620 in the randomizing chamber 186. The accumulated randomized stack 620 thus begins with one card and builds until the input portal 90 is empty. The randomizing cycle will automatically start when the dealer activates a "Shuffle" command on the touch screen as long as sensor 129 detects the presence of a card in the input portal 90. Each new card is inserted into the accumulated randomized stack 620 at randomly chosen elevated positions by the microcontroller, which utilizes a random number generating algorithm to determine the height of each plane between two adjacent cards within the receiving accumulated randomized stack 620. Random number generating algorithms are known in the art as RNG's. The RNG of card device 100 insures that each card is inserted into the accumulated randomized stack 620 at a random position.

Termination of the randomizing cycle is detected by the microcontroller via sensor 129 (see FIG. 21) which indicates when the supply of unshuffled cards has been exhausted. Upon termination of the randomizing cycle, the microcontroller directs that the elevator raise the accumulated randomized stack 620 to the to the upper region of the randomizer chamber where a shuttle 492 moves substacks into the shoe 72.

Figure 31:
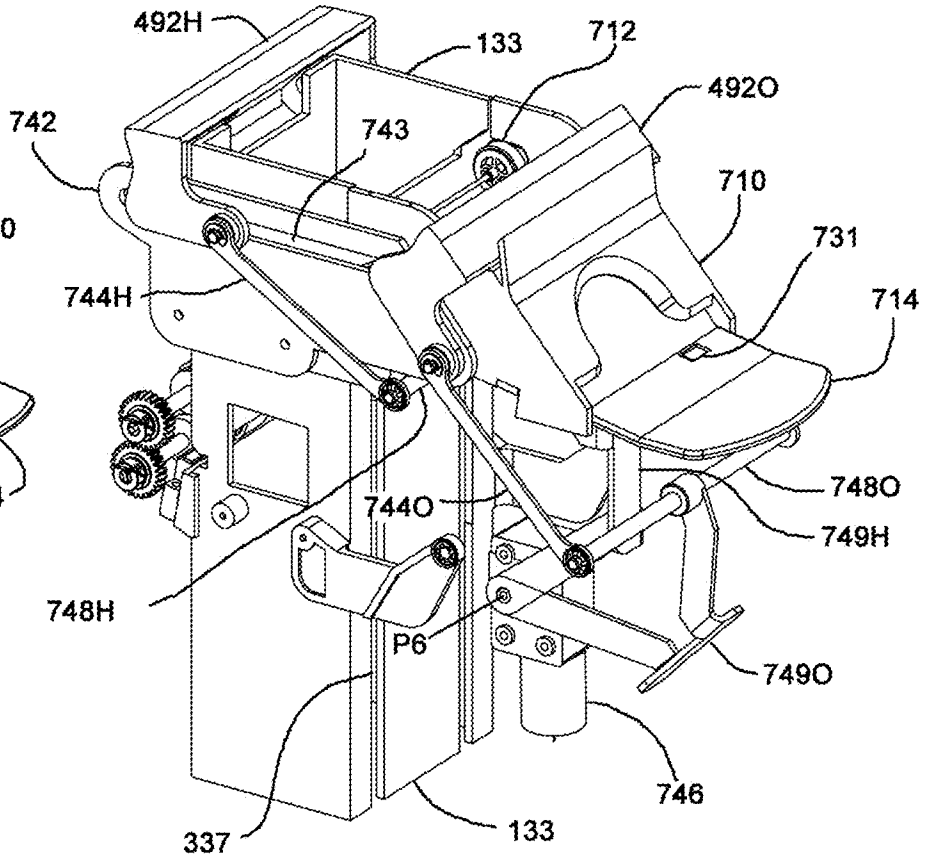
FIG. 30 and FIG. 31 are isometric views illustrating the shuttle mechanism of the device being claimed herein.
Figure 30:
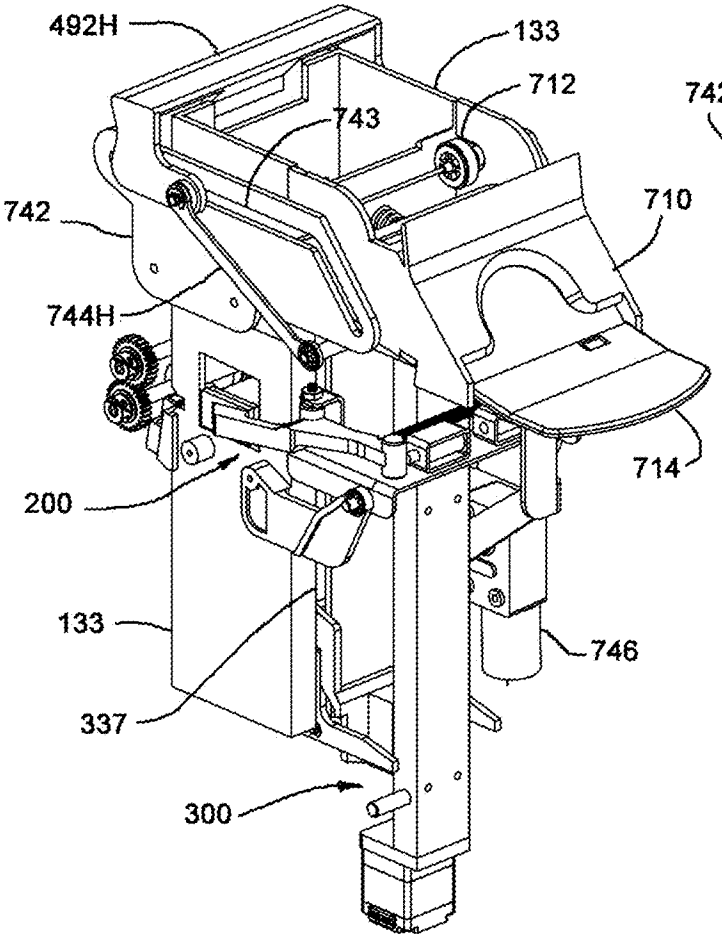

FIG. 30 and FIG. 31 are isometric views of the upper region of the randomizer housing 133 and shoe 72 which illustrate the shuttle 492 and its motorized actuation mechanism. The shuttle 492 is shown in a home position in FIG. 30 and is designated 492H, where the suffix "H" defines the home position. The suffix "O" is used to define the operating position of the shuttle in FIG. 31. The shuttle 492 is a yoke shaped injection molded component that slides along a slotted cam track 743 which is located within a guide plate 742. A second identical guide plate is located upon the opposite side of the housing 133 and is not visible in these views. A motor-driven linkage comprises a link 744H and the yoke 748H, where the "H" suffix defines the home position of these components. The link 744H rotationally connects the shuttle to a yoke 748H which is connected to a bellcrank 748H. The bellcrank 748H is rigidly connected to the shaft of a DC motor gearbox 746 for the purpose of moving the linkage.

The elevator assembly 300 and the gripper mechanism 200 are removed in FIG. 31 for clarity. Again in FIG. 31, the H-suffix of each linkage component defines its home position and the O-suffix of each component indicates its operating position. The shuttle is normally located at a home position labeled as 492H. Actuation of the DC motor gearbox 746 causes the linkage to pull the shuttle 492H along the slotted cam track 743 until the shuttle achieves the position shown by label 4920. The movement of the shuttle 492 from label 492H position to label 4920 position is utilized to skim a substack from the top of the accumulated randomized stack and seat that substack into the shoe.

Figure 31A:
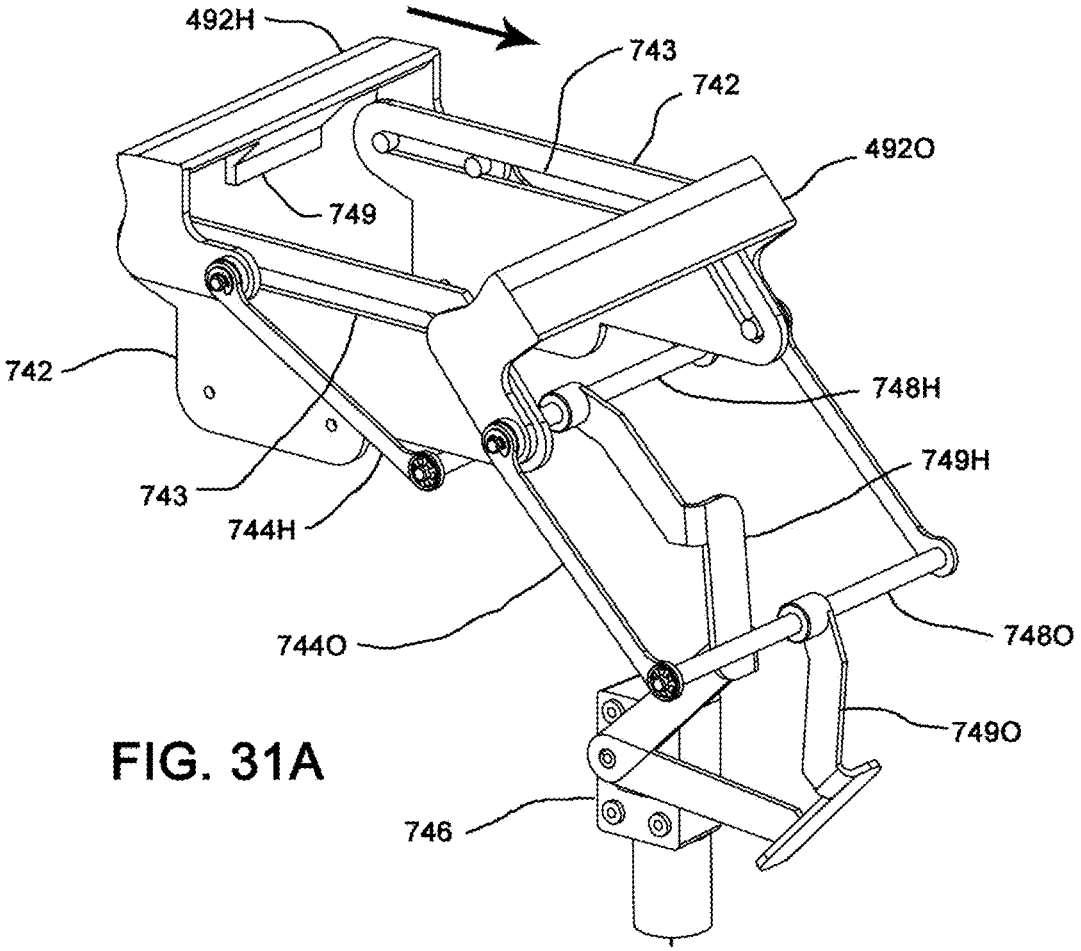
FIG. 31A is an isometric view of the motorized linkage that actuates the shuttle of the device being claimed herein.

FIG. 31A is an isometric view that isolates the shuttle drive mechanism for further clarity and again shows the mechanism located in the home position and the operating position. This view shows that the cam tracks 743 are identically oriented on two identical guide plates 742. This view also shows the shape of the shuttle projection 749 that is used to skim substacks from the accumulated randomized stack.

Figure 32A:
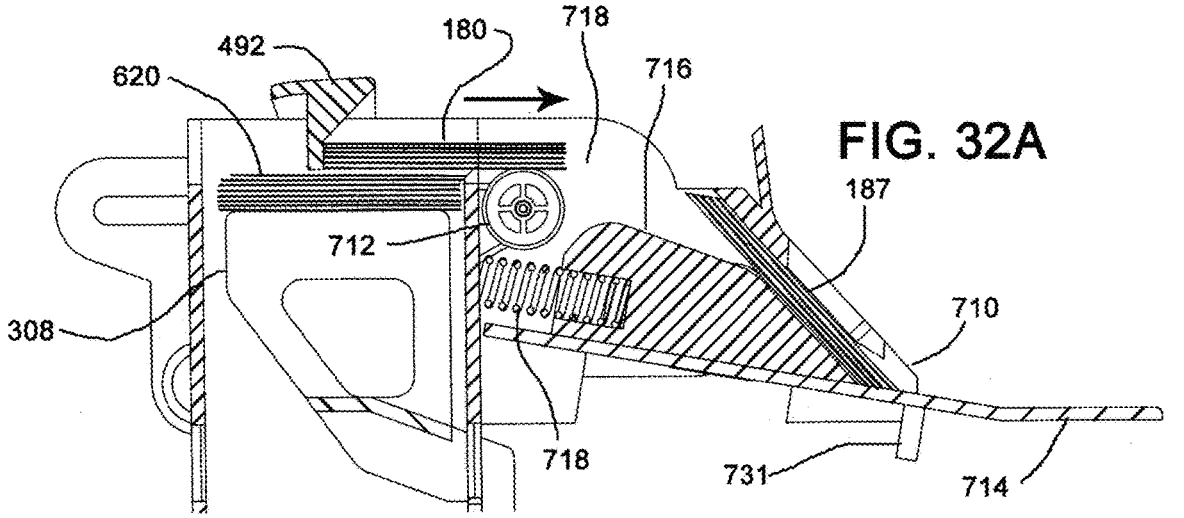
FIG. 32A, FIG. 32B and FIG. 32C are a series of section views which illustrate the progressive motion of the shuttle mechanism of the device being claimed herein when moving substacks into the shoe.
Figure 32B:
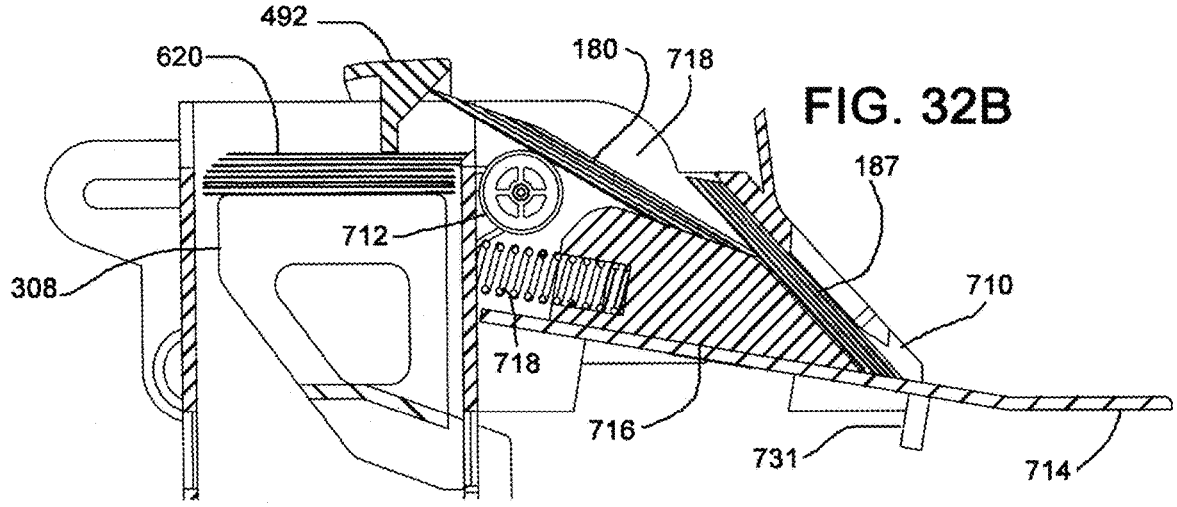
Figure 32C:
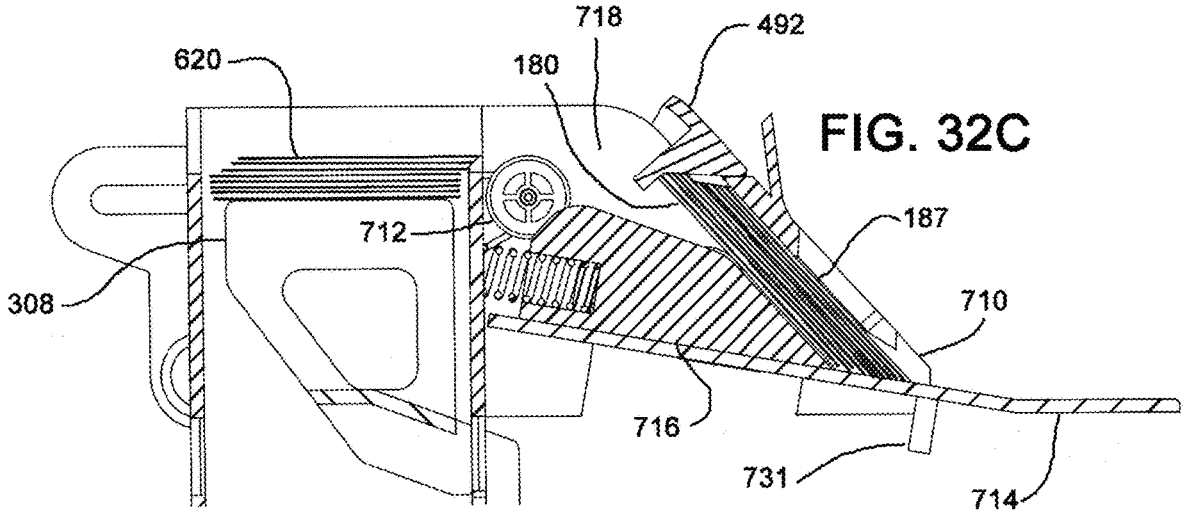

After completion of the shuffling operation, the microcontroller moves the accumulated randomized stack 620 to the position shown in FIG. 22 where the shuttle 492 can skim a substack from the accumulated randomized stack. FIG. 32A through FIG. 32C illustrate section views of the shuttle as it sweeps across the accumulated randomized stack and into the shoe cavity 718. The central region of the shuttle 492 has the cross section shown in FIG. 32A (projection 749) which skims a substack 180 from the accumulated randomized stack 620 as shown in that figure. The shoe roll 712 supports the substack 180 until the substack's center of gravity induces the leading edge of the substack to rotate CW into the shoe cavity 718.

In FIG. 32B, the substack 180 is shown inserted into the V-shaped opening formed by the previous substack 187 and the backer 716. The substack 180 is partially supported by shoe roll 712 and backer 716. A spring 718 biases the backer 718 against the stack 187 which bears upon the inner surface of draw plate 710.

FIG. 32C is a section view of the shoe 72 that illustrates the terminal position of the shuttle having moved the edge of substack 180 into a nearly seated position. It is noted that the geometry of the backer causes the substack 180 to snap into the ultimate position shown in FIG. 32C, such that the yoke need not seat the substack completely. As individual cards are drawn from the shoe at the draw plate 710, the rearmost cards gradually migrate downward and into contact with the surface of apron 714.

The microcontroller keeps a continuous count of the number of cards within the shoe. A sensor 731 is utilized to detect each card as it is removed from the shoe by a dealer as shown in FIG. 31. The microcontroller thereby keeps a count of the number of cards within the shoe at any given moment in time. In one embodiment, the elevator will move the accumulated randomized stack upward to enable the shuttle to move a new substack 180 into the shoe when the card count within the shoe is reduced to 10 cards. The number of cards residing in the shoe during continuous operation will be automatically maintained within the range from 10 to 28 cards when the substacks are configured with a count of 18 cards.

One of ordinary skill, having designer's choice, may choose to utilize different forms of actuators and transport components than those described herein. Other forms of transport components, including cables, gears, chains and other types of belts may be substituted for those described herein. Other types of motors and solenoids are also logical substitutions and other types of sensors may be implemented as is well known in the art. The device may be configured to utilize more or less cards in each substack and the device may be configured to hold more or less cards total cards. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A shoe loading mechanism for maintaining a continuous supply of randomized playing cards within a multi-card shoe, the mechanism comprising:

a multi-card shoe having a shoe cavity including walls for containing a stored stack of randomized cards and a surface for resting upon a playing card surface of a casino table;

one shoe wall comprising a draw plate having a finger opening for receiving a dealer's finger and including an adjacent opening for withdrawing one card at a time from the shoe cavity;

a sensor that is monitored by a microcontroller for counting the withdrawn cards;

the shoe cavity including a support for biasing the stored stack of cards against an inner surface of the draw plate as cards accumulate within the shoe cavity;

the shoe cavity having an opening for receiving randomized cards from an elevator carriage;

the elevator carriage raising the randomized cards from an elevation below the shoe cavity;

the elevator carriage having a single support plane for supporting the randomized cards;

the elevator carriage support plane transiting from an elevation below the playing card surface of the casino table to an elevation above the playing card surface;

a shuttle for moving cards from the elevator carriage into the shoe cavity;

the elevator carriage raising randomized cards to an elevation interceptable by the shuttle after a randomization operation has been completed;

the shuttle moves along a linear path that is parallel to card faces of the randomized cards residing on the elevator carriage;

the shuttle having a surface for contacting edges of the randomized cards residing upon the elevator carriage;

the shuttle movement taking place at an elevation above the stored stack of cards;

the elevator carriage elevation remaining below the shuttle;

wherein the shuttle maintains a continuous supply of multiple cards within the shoe cavity by moving cards from the elevator carriage into the shoe when the card count within the shoe is reduced below a certain threshold number.

2. The shoe loading mechanism of claim 1 wherein the shuttle has a home position for allowing the elevator carriage to raise the randomized card stack.

3. The shoe loading mechanism of claim 1 wherein the shuttle has a terminal position for seating cards within the shoe cavity.

4. The shoe loading mechanism of claim 1 wherein the shuttle moves cards into the shoe cavity from an elevation above the stored stack of cards.

5. The shoe loading mechanism of claim 1 wherein the shuttle's movement is guided by cam tracks.

6. The shoe loading mechanism of claim 1 wherein the shuttle is controlled by a motor.

7. The shoe loading mechanism of claim 1 including a shoe roll which induces angular rotation of cards as they enter into the shoe cavity.

8. The shoe loading mechanism of claim 7 wherein cards moving into the shoe are partially supported by the shoe roll.

9. The shoe loading mechanism of claim 1 wherein the microcontroller cooperates with the sensor to maintain a count of the cards residing within the shoe at any given moment in time.

10. The shoe loading mechanism of claim 1 wherein the elevated position of the elevator carriage is controlled by an elevator motor.

11. The shoe loading mechanism of claim 1 wherein the elevator incrementally raises the randomized cards on the elevator carriage by a distance equal to a combined thickness of a predesignated number of cards when moving cards into the shoe cavity.

12. The shoe loading mechanism of claim 1 wherein the microcontroller decides when to actuate the shuttle based upon a number of cards residing within the shoe.

13. The shoe loading mechanism of claim 1 wherein elevator movement is bounded by a randomizing chamber.

14. The shoe loading mechanism of claim 13 wherein the randomizing chamber extends both above and below the playing card surface of the casino table.

15. The shoe loading mechanism of claim 1 wherein the elevator carriage reciprocates upwardly and downwardly within a randomizing chamber while randomizing cards.

* * * * *